US005125987A

United States Patent [19]

Eguchi et al.

[11] Patent Number: 5,125,987

[45] Date of Patent: Jun. 30, 1992

[54] METHOD FOR DIRECT PATENTING OF A HOT-ROLLED WIRE ROD

[75] Inventors: Toyoaki Eguchi; Noriyoshi Ohwada; Yutaka Sagae; Hirotada Ohsuzu; Katsumi Ito, all of Tokyo, Japan

[73] Assignee: Toa Steel Co., Ltd., Tokyo, Japan

[21] Appl. No.: 738,168

[22] Filed: Jul. 30, 1991

Related U.S. Application Data

[63] Continuation of Ser. No. 362,021, Jun. 6, 1989, abandoned.

[30] Foreign Application Priority Data

Jun. 13, 1988 [JP] Japan ..... 63-145366

[51] Int. Cl.[5] ..... C21D 8/06

[52] U.S. Cl. ..... 148/595; 148/601; 148/662

[58] Field of Search ..... 148/12 B, 12.4, 153, 148/143

*Primary Examiner*—Deborah Yee

*Attorney, Agent, or Firm*—Frishauf, Holtz, Goodman & Woodward

[57] ABSTRACT

A method for direct patenting of a hot-rolled wire rod comprises the steps of: transporting a hot-rolled wire rod on a conveyer in a state that said wire rod is in a form of continuous series of loops; blasting mist to the surface of said wire rod at least from above and blasting air to the back side of the wire rod from below to cool the wire rod at a rate of 12° C. to 50° C./sec. down to 550° C. to 400° C. during the transportation, the mist provides 200 to 2400 l/min. water and has an air to water ratio of 200 $Nm^3/m^3$ or less; and reheating the cooled wire rod at a rate of 3° C./sec. or less, or cooling the cooled wire rod slowly at a rate of 2° C./sec. or less during the transportation. In addition, another method for direct patenting of a hot-rolled wire rod comprises the steps of: transporting a hot-rolled wire rod on a conveyer in a state that the wire rod is in a form of continuous series of loops; cooling, as a first cooling step, the wire rod at a rate of 12° to 40° C./sec. down to 600° C. to 450° C. during the transportation by means of blasting a cooling medium to the wire rod for 5 secs. to 30 secs.; and cooling, as a second cooling step, the cooled wire rod st a rate of 2° C. to 15° C./sec.down to 550° C. to 400° C. during the transportation by means of blasting a cooling medium to the wire rod cooled in the first cooling step for 5 secs. to 30 secs.

30 Claims, 15 Drawing Sheets

METHOD FOR DIRECT PATENTING OF A HOT-ROLLED WIRE ROD

This application is a continuation application of Ser. No. 07/362,021 filed Jun. 6, 1989 now abandoned.

BACKGROUND OF THE INVENTION

1. Field of the Invention

The present invention relates to a method for direct patenting of a hot-rolled wire rod.

2. Description of the Prior Arts

Now at present, as a direct patenting method of a hot-rolled wire rod, Stelmor method is widely used. In this Stelmor method, a wire rod having been hot-rolled at a temperature of 800° C. to 900° C. are firstly coiled into a form of series of loops by a coiler, and the wire rod is dropped and introduced to a conveyer and is transported thereon in a state of being in a form of continuous series of loops. And then, the wire rod is forced to rapidly be cooled by air-blast at a rate of 10 m to 60 m/sec. from the down side of the conveyer during the transportation, thereby to strengthen the wire rod. The capability of the air blast cooling, however, is limited to a certain extent. When it comes to a wire rod with 11 mm in diameter, the speed of this air-blast cooling becomes so low as to be approximately at a rate of 5° C. to 10° C./sec. When a wire rod of high carbon steel is produced by this air-blast cooling, because of the low speed of the air blast cooling, the wire rod is reduced to being low in its strength and ductility, compared with that which is produced in off line lead patenting (herein after referred to as "LP").

As one of the prior art means to cover this disadvantage, a method of using a warm water or salt bath is widely known. But, by means of this warm water, a speed of water cooling as much as that of LP cannot be obtained. On the other hand, the salt bath has disadvantages in that the salt bath not only takes much time to dissolve the salt in the salt bath but also increases investment cost for equipment and facilities as well as running cost.

As an alternative of said prior art means to more simply improve cooling capability of said Stelmor method, a mist blasting method is disclosed in Japanese Patent Application Laid Open (KOKAI) No. 112721/76, wherein water of 0.01 to 0.05 l/air-blast of 0.1 $m^3$ is sprayed. Furthermore, in Japanese Patent Application Laid Open (KOKAI) No. 138917/78, it is disclosed that air-blast which is mixed with water of 0.06 to 0.27 l/$Mn^3$ to turn into mist is used. These prior art methods, however, teaches only that cooling capability is improved by using merely mixing air blast with water. According to LP, because of its use of a constant temperature bath at about 520° C., pearlite transformation is performed at an isothermal transformation (TTT transformation), and the transformation is performed at the vicinity of a nose in a graphic representation of the transformation. Therefore, in LP, a fine pearlite structure can be obtained. But, when a continuous cooling transformation (CCT transformation) is carried out, in case of over cooling, bainite or martensite is produced even if the cooling capability is merely increased. Namely, even if rapid cooling is effected to the vicinity of the pearlite nose temperature, the pearlite transformation does not start yet, or just starts. Since thereafter most of austenite which is not transformed yet will begin to be transformed, the product quality becomes very fluctuant unless moreover temperature of finishing rapid cooling and heat treatment pattern subsequent to the rapid cooling are closely controlled. A wire rod which is produced by means of this continuous cooling method does not match, in quality, features of that produced by means of LP method.

Various methods have been studied to overcome said limit of the continuous cooling. Japanese Patent Application Laid Open (KOKAI) No. 41323/81 discloses a method wherein a wire rod which has been hot-rolled is cooled by means of control cooling at a cooling speed of forming a sorbite structure down to a temperature higher than a temperature Point $M_s$ at which martensite transformation starts, and subsequently the wire rod is reheated up to a temperature as high as TTT curve nose, thereby to procure a time enough for austenite not yet transformed to complete its transformation. Another method is also disclosed in Japanese Patent Application Laid Open (KOKAI) No. 214133/87, wherein after rapid cooling of a hot-rolled wire rod down to the vicinity of 550° C. of the pearlite nose temperature, the temperature is constantly maintained by blasting a hot air at a temperature over $M_s$ point but less than the nose temperature. These methods of reheating a wire rod to a certain temperature to keep the temperature constant by reheating and of using hot air blast both are disadvantageous in that they require a great deal of construction cost, compared to a method of performing a slow cooling simply.

Recuperation occurring due to exothermic reaction which is accompanied by the pearlite transformation does not exceed about 20° C., when rapid cooling is carried out, for example, in a lead bath at a temperature of 520° C., because the heating is reduced due to the large heat transfer feature of the lead bath. But if a hot-rolled wire rod is cooled by a mist blast method down to a temperature at which the transformation begins and the wire rod is put into an electric heating furnace, the recuperation reaches 70° C., but the pearlite structure of the wire rod obtained therefrom is coarse and the wire rod is far from having mechanical properties equivalent to that of a wire rod produced by the lead patenting. To produce a wire rod of such mechanical properties, it is required to increase the cooling speed and, at the same time, to have the transformation starting temperature go down. But the drop of the starting temperature delays remarkably the completion of the transformation and prolongs the time necessary for maintaining the constant temperature, and therefore, this is disadvantageous in view from equipment and facilities. In addition, in case that the temperature goes excessively down, there is a danger of producing an over cooling structure such as bainite in the products.

Moreover, the increase in the cooling speed for a large diameter wire rod with 13 mm or so gets difficult, compared to cooling a small diameter wire rod with 5.5 mm.

When the diameter become large and the starting temperature of the cooling also becomes high, it is required to compulsorily restrain the elevation of the temperature due to the repecuration.

SUMMARY OF THE INVENTION

The object of the present invention is to provide a method for producing a wire rod which is excellent in strength and ductility.

To attain the object, in accordance with the present invention, a method is provided for direct patenting of a hot-rolled wire rod, comprising the steps of:

transporting a hot-rolled wire rod on a conveyer in a state that said wire rod is in a form of continuous series of loops, said wire rod containing C in an amount of 0.40 to 1.00 wt. %:

blasting mist to the surface of said wire rod at least from above and blasting air to the back side of said wire rod from below to cool said wire rod at a rate of 12° to 50° C./sec. down to 550° C. to 400° C. during the transportation, said air-water mist providing 200 to 2400 l/min. water and has an air to water ratio of 200 $Nm^3/m^3$ or less; and recuperating (i.e. reheating) said cooled wire rod at a rate of 3° C./sec. or less during the transportation.

Furthermore, in accordance with the present invention, a method is provided for direct patenting of a hot-rolled wire rod, comprising the steps of:

transporting a hot-rolled wire rod on a conveyer in a state that said wire rod is in a form of continuous series of loops, said wire rod containing C in an amount of 0.40 to 1.00 wt. %;

blasting mist to the surface of said wire rod at least from above and blasting air to the back side of said wire rod from below to cool said wire rod at a rate of 12° to 50° C./sec. down to 550° C. to 400° C. during the transportation, said air-water mist providing 200 to 2400 l/min. water and has an air to water rate of 200 $Nm^3/m^3$ or less; and cooling said cooled wire rod slowly at a rate of 2° C./sec. or less during the transportation.

Furthermore, accordance with the present invention, a method is provided for direct patenting of a hot-rolled wire rod, comprising the steps of:

transporting a hot-rolled wire rod on a conveyer in a state that said wire rod is in a form of continuous series of loops, said wire rod containing C in an amount of 0.40 to 1.00 wt. %;

cooling, as a first cooling step, said wire rod at a rate of 12° to 40° C./sec. down to 600° C. °C. to 450° C. during the transportation by means of blasting cooling medium to said wire rod for 5 secs. to 30 secs.; and cooling, as a second step, said cooled wire rod at a rate of 2° to 15° C./sec. down to 550° C. to 400° C. during the transportation by means of blasting a cooling medium to said wire rod cooled in the first cooling step for 5 sec. to 30 secs.

The object together with other objects and advantages which will become subsequently apparent reside in the details of construction and operation as more fully hereinafter described and claimed, reference being had to the accompanying drawings forming a part of hereof.

DESCRIPTION OF THE PREFERRED EMBODIMENT

Preferred Embodiment-1

Figure 1:
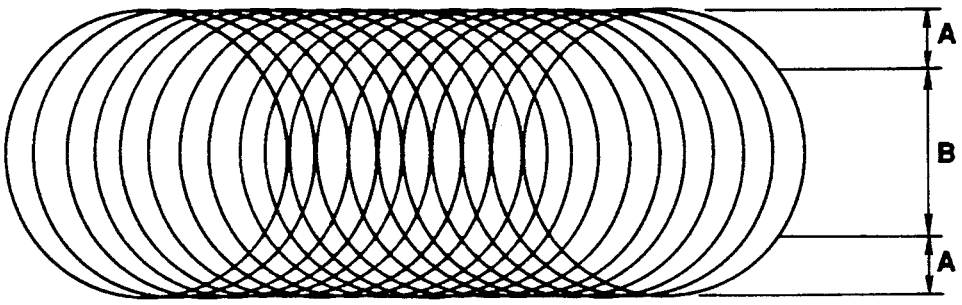
FIG. 1 is a schematic plan view showing a overlapping state of hot-rolled rod being transported in a form of continuous series of loops in accordance with the present invention.

This Preferred Embodiment relates to a method for direct patenting of a hot-rolled wire rod during the transportation of the wire-rod, and lies especially in carrying out close control for homogeneously cooling the wire rod such as forming air-mist, cooling the wire rod down to 550° C. to 400° C., subsequent slow cooling or recuperation.

Firstly, the reasons why chemical and physical limitations are numerically defined will now be described.

It is desirable that C content ranges 0.40 to 1.00 wt. %. If C content is less than 0.40 wt. %, a wire rod having a good strength is not produced. On the other hand, if over 1.00 wt. %, ductility of the wire rod is deteriorated. Furthermore, Si of 0.35 wt. % or less, Mn of 0.30 to 1.00 wt. % P of 0.04 wt. % or less, S of 0.040 wt. % or less are preferable. Al and Ti are generally used as elements for controlling crystal grain size.

Air-water mist which is blasted to a wire rod from above is preferably prepared so as to provide 200 to 2400 l/min. water have an air to water and ratio of 200

$Nm^3/m^3$ or less. The amount of cooling water supplied on a conveyer ranges thus from 200 to 2400 l/min. because if the amount is less than 200 l/min., it is hard to procure sufficient cooling effect and if over 2400 l/min., over cooling is easy to occur. Furthermore, the reason for the air to water ratio of 200 $Nm^3/m^3$ or less is that if the ratio is over 200 $Nm^3/m^3$, the number of water particles become so small that the cooling capability is deteriorated. Furthermore, it is more preferable that the air to water ratio is 5 $Nm^3/m^3$ to 200 $Nm^3/m^3$. With a ratio of 5 $Nm^3/m^3$ or more, it becomes easy to obtain a wire more uniform. Water particles even if the air-to-water ratio is made to be zero, the effect can be equivalent to that of the case of 5 $Nm^3/m^3$ to 200 $Nm^3/m^3$, providing that the air blast from below is strongly blown. Air-to-water ratio is a mixed ratio of air and water and is represented by the formula of air amount($Nm^3$) /water amount($m^3$).

Portions of loops of a wire rod located on both periphery end side portions of a conveyer are overlapped much more closely than portions of the loops on the center line portion of the conveyer. Especially the portions of the loops located on the very periphery portions of the conveyer are overlapped substantially in multiplicate, and therefore, mere one side blast cooling of the wire rod from above or below fails almost completely to hit the loops of the wire rod on the other side of the loops receiving directly the cooling blast. Consequently, the cooling speed of the wire rod become remarkably ill-balanced. Because of this imbalance of the cooling speed, the strength of the wire rod is widely deviated. To prevent this deviation, blasting to a wire rod on both sides, namely from above and below, is recommendable. Seemingly in general, it looks like the air-blast from below blows away the air-water mist from above thereby to lose the effect of the both side cooling, but the fact is not so. This is because the air-water mist blast from above is supplied approximately 400 mm above the wire rod and therefore, the flow speed of the air-water mist is high enough to exceed that of the air-blast. Therefore, the flow speed of the air-water mist is never beaten by that of the air-blast.

The difficulty in applying the mist to a wire rod is that the wire rod is transported on a conveyer not in a form of a straight line but in a form of continuous series of loops, being placed flatly and overlappedly, as shown in the plan view thereof of FIG. 1. Since portions A of both side ends of the loops are overlapped more than center portion B of the loops, there is a problem of a deviation of the cooling speed. In case that the air blast cooling whose cooling speed is small, the problem can be settled to considerable extent by arranging air blast amount hitting portions A and B through a rectifier plate which is set at the back side of the conveyer. In case of the air water mist blast cooling, the deviation of the cooling speed cannot be controlled, by means of merely arranging the distribution amount of the air-water mist hitting portions A and B, to the extent that it is practically operational without an obstacle of the deviation, because the cooling speed of the mist blasting is very large. The inventors found it effective in supressing the deviation of the cooling speed of the wire rod that the cooling is being carried out on both sides of the wire rod during the transportation or that the wire rod is made to be advanced in a zigzag movement during the transportation to have contact points of the loops constantly changed.

Figure 2:
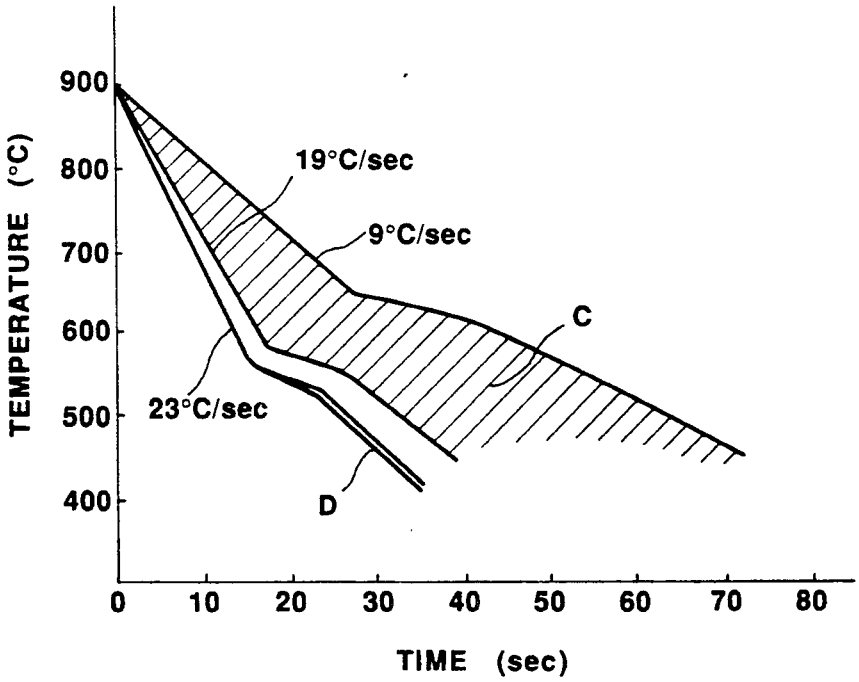
FIG. 2 is a graphic representation showing deviation of cooling speed of two overlapped loops of a wire rod when the wire rod is cooled by a mist cooling from above or from above and below during the transportation in accordance with the present invention.
Figure 3:
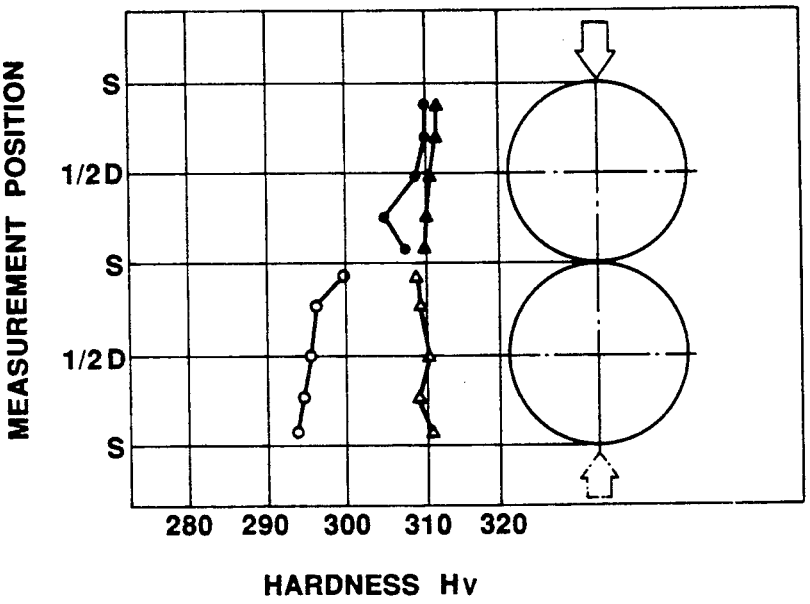
FIG. 3 is a graphic representation showing deviation of hardness of two overlapped loops of a wire rod when the wire rod is cooled by a mist cooling from above or from above and below during the transportation in accordance with the present invention.

FIG. 2 graphically shows deviation of cooling speeds of two overlapped loops of a wire rod when the two loops are cooled from above or from above and below in accordance with the present invention. The two loops of the wire rod of SWRH 62B with 14 mm in diameter were overlapped with one loop on the other vertically in duplicate, and cooling speeds of the two loops of the wire rod in two cases were measured by a thermocouple. In one of the two cases, the mist blast was carried out exclusively from above and in the other case, the mist blast was done from both above and below. In the graph, C indicates deviation of the cooling speed in case of one side cooling, exclusively from above and D indicates deviation of the cooling speed in case of the both side cooling, namely from both above and below. In the one side cooling, the cooling speeds of one of the two loops of the wire rod which the mist-blast hit was about 19° C./sec., while the cooling speeds of the other which the blast did not hit were about 9° C./sec. as half as that of the hit side loop of the wire rod. In contrast, in the both side cooling, either of the cooling speeds of the both loops was about 23° C./sec. and the deviation of the cooling speeds are seen to be almost zero. FIG. 3 graphically shows deviation of hardness of the two overlapped loops when the two loops were cooled from above or from above and below. Symbol "●" indicates hardness of the upper side loop of the wire rod in case of the cooling exclusively from above and symbol "○" hardness of the lower side loop of the wire rod in case of the cooling from above, symbol "▲" hardness of the upper side in case of the cooling in case of the cooling from both above and below, and symbol "Δ" hardness of the lower side in case of the cooling from both above and below. In the case of the one side cooling, the difference of hardness between those shown by symbols "○" and "●" was about 15 by Vickers hardness and about 5 $kg/mm^2$ by tensile strength in conversion thereof. In contrast, in the both side cooling, the difference of hardness between those shown in symbols "Δ" and "▲" made almost no difference. Therefore, from the above comparison, the both side mist cooling is preferable.

In this Preferred Embodiment, air-water mist is blasted from above to a wire rod and air-blast from below.

The mist included in the air-water mist blast gets into and mixes with air-blast coming up from below and the air-blast turns to be a air-blast mist owing to the mixture. Resultantly, the mist cooling is carried out from above and below.

The reason for the mist cooling of the wire rod at a rate of 12° to 50° C./sec. down to 550° to 400° C. is that if the temperature is over 550° C., a fine pearlite structure is not formed and the structure of the wire rod becomes coarse and that if less than 400° C., an over-cooled structure such as martensite is easy to appear. Furthermore, if the cooling speed is less than 12° C./sec., the speed is so small that the fine pearlite cannot be formed and a satisfactory strength cannot be obtained either, and if over 50° C./sec., there is an increase in possibility of an over-cooled structure being formed.

The reason for the further cooling the wire rod at a rate of 2° C./sec. or less down to 550° to 400° C. or the recuperating the wire rod at a rate of 3° C./sec. or less is as follows: if the cooling rate is more than 2° C./sec., an overcooled structure is easy to be formed. The recuperation is carried out by having a conveyer covered over with a cover or by heating the wire rod through an appropriate heat source. If the recuperation is carried out at a rate of more than 3° C./sec., a great deal of heat is required and the cost therefor becomes expensive. If the recuperation is made to a temperature higher than 600° C., an austenite structure which has not yet been transformed is transformed to a coarse pearlite. Thanks to the recuperation ranging from 500° C. to 600° C., an austenite structure which has not yet transformed can be transformed to a fine pearlite and the formation of the over-cooled structure can be stopped.

In this Preferred Embodiment-1, a hot-rolled wire rod is transported in a form of continuous series of loops and the loops are advanced straightforward, but instead of this straightforward transportation, it is possible to have the loops of the wire rod transported in zigzag movement. Due to the zigzag advancement, overlapped portions of loops of a wire rod on both periphery end side portions of a conveyer make a snake movement, namely make a way to the left and the right in turn during the transportation. Resultantly, this movement have the cooling homogeneously effected. To have the wire rod transported in zigzag advancement, the wire rod is made to turn to the left and the right in turn by an interval of 0.3 to 2.0 of length D in the advancing direction and diagonally relative to the center line of the conveyer and still further to have each center of the conveyer, the deviation being within a maximum range of a length range of 0.02 to 0.3 of length D. Length D is a diameter of the loops formed by the wire rod.

Figure 4:
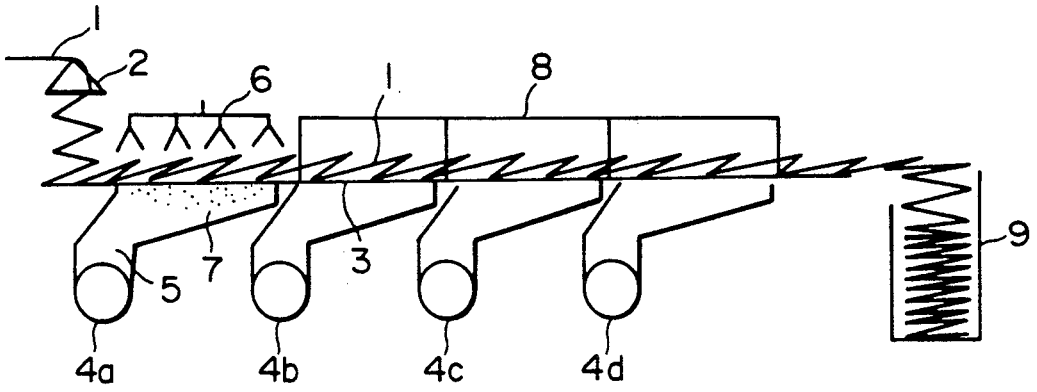
FIG. 4 is a schematic side view illustrating an apparatus which is used for performing Preferred Embodiment-1 of the present invention.

FIG. 4 schematically shows a side view of an apparatus for this Preferred Embodiment-1. Wire rod 1 which has been finally rolled is coiled by coiler 2 at a temperature of about 800° C. to 900° C. The wire rod is dropped to conveyer 3 and is transported by the conveyer in a form of continuous series of loops. In the conventional Stelmor method, air-blast 5 is produced and blown to the wire rod by using air-blowers 4*a* and 4*b* to cool the wire rod from below the wire rod. In this Embodiment-1, the first cooling step in the first cooling zone is carried out, by air blower 4*a*, from above and below. From above an air-water mist is produced and blasted to the wire rod by air mist maker 6. The air-mist having been blasted from above is mixed with the air-blast blown from below to turn to be an air-water mist blast having fine water particles 7. From below, the lower side of the wire rod is cooled by this air-water mist blast. The wire rod is cooled down to 550° C. to 400° C. by the cooling from above and below. The cooled wire rod is further cooled at a rate of 2° C./sec. or less in a state of being covered with heat-holding cover 8, or the cooled wire rod is heated at a rate of 3° C./sec. or less, and the transformation of the wire rod is completed. Then, the wire rod is collected by means of reforming tub 9.

It should be noted that number of air-blowers to be used can be increased or decreased, depending on transportation speed of a wire rods, although in this Preferred Embodiment-1 four air blowers are employed. Instead, each of cooling zones can be divided into two so as use two air-blowers 4. In this Preferred Embodiment-1 each of the cooling zones is 1600 mm wide and 9000 mm long.

Figure 5:
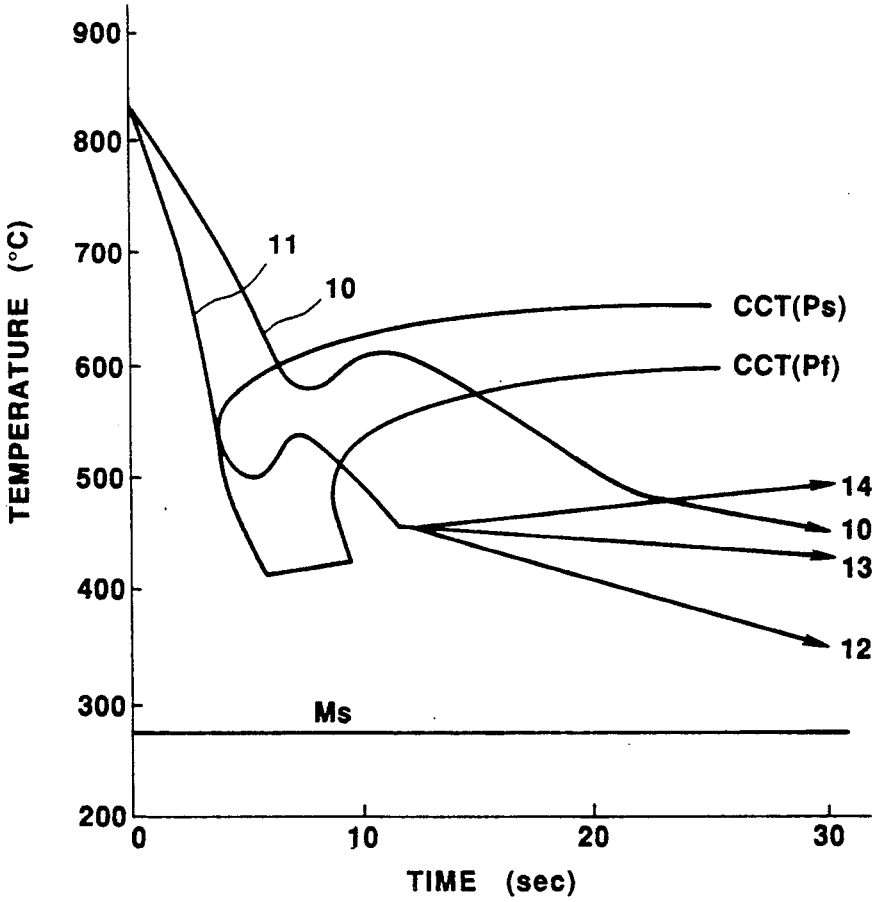
FIG. 5 is a graphic representation showing transformation curves of wire rods and various heat treatment patterns applicable to the transformation curves in accordance with the present invention.

FIG. 5 graphically shows transformation curves of a wire rod of SWRH 62B and various heat treatment patterns applied to the wire rod. Cooling curve 10 is that of a conventional Stelmor Method. In this conventional method, the transformation temperature is so high as to be 600° C. and a structure to be formed becomes a coarse pearlite structure. Cooling curve 11 is a cooling curve in case that the mist cooling is carried out in accordance with Preferred Embodiment-1. In this case the transformation temperature is so low as to be about 520° C. and a fine pearlite structure can be produced. Cooling curve 12 is a cooling curve reflecting a case of a Control wherein cooling is carried out at a rate of more than 2° C./sec. after the mist cooling has been done.

In this Control, there is possibility that austenite remaining in the wire rod is transformed to an over-cooled structure such as martensite. Cooling curves 13 and 14 reflect cases of Preferred Embodiment-1. Cooling curve 13 is a case wherein a wire rod is slowly cooled in heat-holding cover 8 for holding heat. Cooling curve 14 is that which represents a case wherein a wire rod is heated in cover 8 and the recuperation is effected. In case of either of cooling curves 13 and 14, a fine pearlite can be formed. Moreover, keeping a temperature constant can be carried out, the temperature having been made by the mist rapid cooling. This keeping of the constant temperature is also covered by the scope of the present invention. In FIG. 5, CCT is a cooling curve for performing continuous cooling transformations, $P_s$ being a starting point of pearlite transformation, $P_f$ being a finishing point of pearlite transformation and $M_s$ being a starting point of a martensite transformation.

Figure 6:
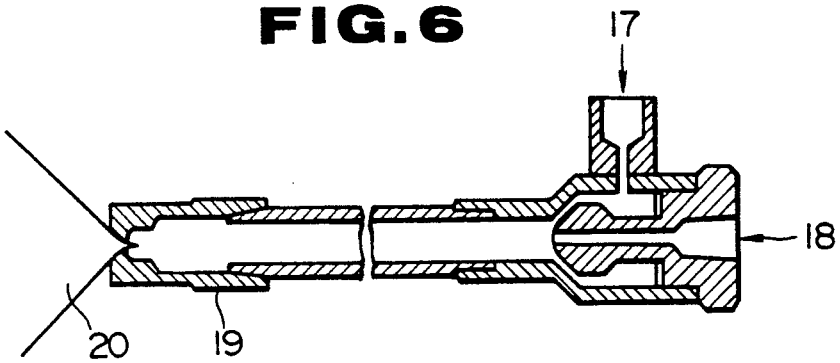
FIG. 6 is a view of a spray nozzle for blasting an air-water mist which is used for performing the present invention.

FIG. 6 schematically illustrates an air-water mist nozzle used for the present invention. Water introduced through water inlet 17 is mixed with high pressured air also introduced through air inlet 18 to form a mixture thereof and the mixture, as air water mist 20 is made to be sprayed over the wire rod. By means of having the water blasted out as minute particles, a high cooling speed and a soft hitting power is produced.

Figure 7:
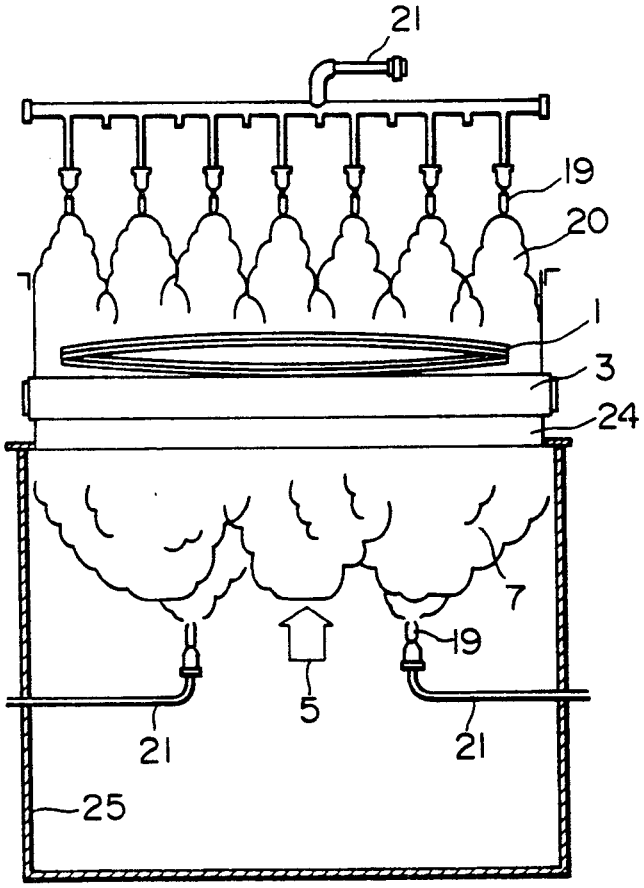
FIG. 7 is a front view of another apparatus which is used for performing the present invention.
Figure 8:
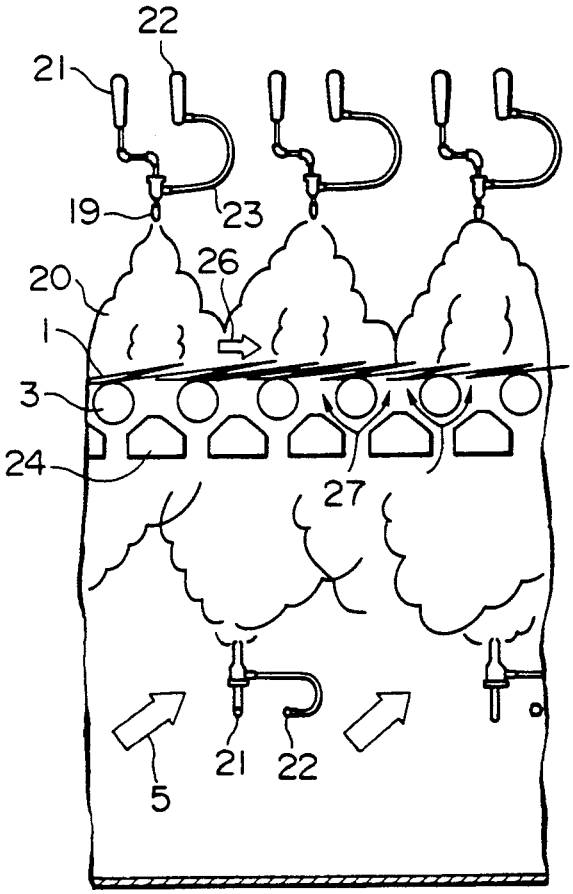
FIG. 8 is a side view of the apparatus illustrated in FIG. 7.

FIG. 7 illustrates a front view of another apparatus for performing the present invention. FIG. 8 illustrates a side view of the apparatus illustrated in FIG. 7. FIGS. 7 and 8, 21 denotes air supply pipes, 22 a water supply pipes, 23 flexible hoses, 24 rectifier plates, 25 an air-blast box, 26 a direction toward which a wire rod advances and 27 flows of air-water blast mist which air-blast coming up from below and air-water-mist coming up from below are mixed to turn into. The apparatus is one wherein cooling a wire rod is carried out by means of air-water mist through nozzles from above and by air-water blast mist from below. The apparatus is classified into three kinds: (a) a method wherein air-water nozzles are placed in an air blast box as shown in the drawing; (b) a method wherein nozzles are set on rectifier plates; and (c) a method wherein air-water mist is sprayed, passing through room formed between rollers set to the conveyer. Furthermore, it is preferable that mist blown to the wire rod both from above and from below should be naturally controlled in flow amount, so as to have the mist increased near the side portion of the conveyer and decreased in amount near the center portion of the conveyer, depending on how much the loops of the wire rod are overlapped.

Preferred Embodiment-2

This Preferred Embodiment-2 comprises a first cooling step wherein a hot-rolled wire rod is cooled down to 600° C. to 450° C. at a rate of 12° to 40° C./sec. for 5 secs. to 30 secs. by means of blasting a cooling medium to the wire rod and a second cooling step wherein the hot-rolled wire rod is cooled down to 550° C. to 400° C.

at a rate of 2° C. to 15° C./sec. for 5 secs. to 30 secs. by means of blasting a cooling medium to the wire rod.

Figure 9:
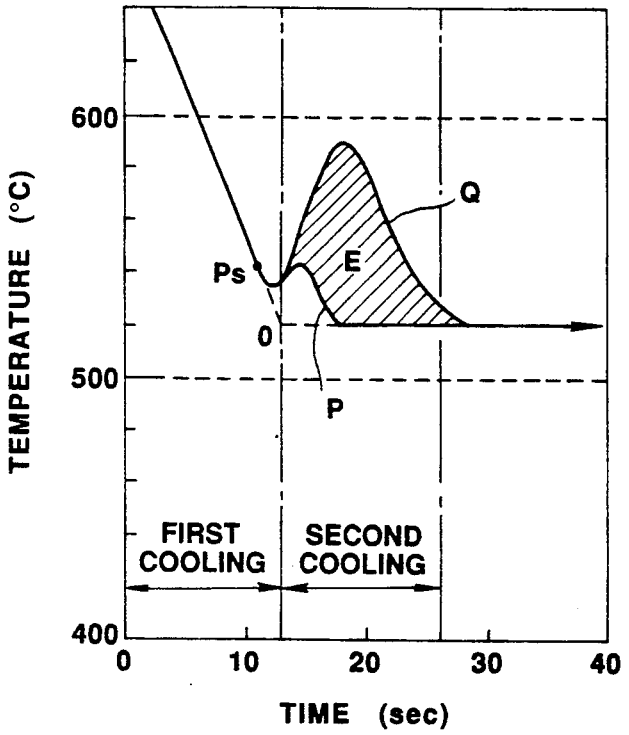
FIG. 9 is a graphic representation showing cooling curves of a wire rod in a prior art practice.
Figure 10:
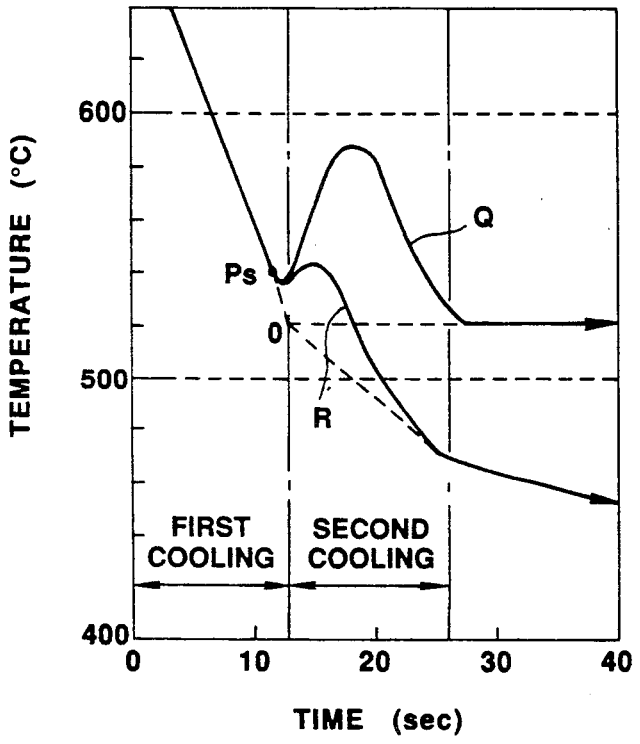
FIG. 10 is a graphic representation showing cooling curves of a wire rod of Preferred Embodiment-2 of the present invention.

FIG. 9 graphically shows cooling curves of a wire rod in accordance with a prior art practice. Curve P is a cooling curve in case that a wire rod is rapidly cooled in a 520° C. lead bath. Curve Q is one in case a wire rod is kept constant in a 520° C. electric heating furnace after the wire rod has been cooled down to that temperature. Recuperation starts at $P_s$ point where pearlite transformation starts. The recuperation of Curve P is so small as to amount to about 10° C., while that of Curve Q is large enough to amount to about 60° C. Namely, the recuperation of curve Q is larger than that of curve P as much as slant portion E in the graph. Owing to this increase in the recuperation, coarse pearlite appears. FIG. 10 graphically shows cooling curves a wire rod in accodance to this Preferred Embodiment-2. As shown by curve R, the recuperation can be restrained as much as that of LP by means of applying to the wire rod in the second cooling step thereby to obtain a fine pearlite structure.

Now, the reasons why numerical limitations are chemically and physically defined will be described below.

It is desirable that C content ranges 0.40 to 1.00 wt.,%. If C content is less than 0.40 wt.%, a wire rod having a good strength is not produced. On the other hand, if over 1.00 wt.%, ductility of the wire is deteriorated. Furthermore, Si of 0.35 wt.% or less, Mn of 0.30 to 1.00 wt.%, P of 0.04 wt.% or less, S of 0.040 wt.% or less are preferable. Al and Ti are generally used as elements for controling crystal grain size. In order to strengthen a wire rod, Si and Mn can be out of the specified ranges thereof in the forgoing as the case may be required. Moreover, elements such as Cr, Ni and V which contribute to improving hardenability or promoting precepitation hardening can be added.

Time for blasting a cooling medium in the first cooling step ranges preferably from 5 secs. to 30 secs. If it is less than 5 secs., the time is too short to complete the desired cooling and therefore, a much greater cooling speed is required. If it is over 30 secs., the necessary equipment and facilities is had to be long.

Cooling speed in the first cooling step ranges preferably from 12° C./sec. to 40° C./sec. Less than 12° C./sec. fails to produce fine pearlite structure of a wire rod. The range of 12° C./sec. to 40° C./sec. can produce a wire rod having a pearlite structure well enough to be fine. For the object of the present invention, the temperature more than 40/sec. is not required.

It is preferable that a temperature of a wire rod which has completed the first cooling step ranges from 600° to 450° C. If the temperature after the rapid cooling is over 600° C., a wire rod with a high tensile strength cannot be produced. To produce a wire rod with mechanical properties better than those of LP patented wire rods, a preferable temperature is 550° C. or less. The cooling of a wire rod at a temperature less than 450° C. in the first cooling step have the wire rod with an over cooling structure such as bainite produced. The range of 550° C. to 450° C. is more preferable. In case that a wire rod is recuperated to about 500° C. after the rapid cooling, fine pearlite structure can be obtained without appearance of an over cooling structure, even if the wire rod is cooled between 450° C. to 400° C.

Time for blasting a cooling medium in the second cooling step is recommended to be 5 secs. to 30 secs. as well as that in the first cooling step. Less than 5 secs. is too short to attain the desired cooling, and therefore, a much greater speed is required. Over 30 secs. gives a disadvantage in making the equipment and facilities long.

Cooling speed for a wire rod after the second cooling s tep ranges preferably 2° C./sec. to 15° C./secs. If low cooling is carried out at a rate of less than 2° C./sec., a small size wire rod with about 5.5 mm in diameter requires a heating furnace. Furthermore, the recuperation temperature becomes so large that coarse pearlite structures are easy to appear. If the cooling speed is over 15° C./sec., it is disadvantageous in that an over cooling structure appears. Over 8 but 15° C./sec. or less can produce a wire rod with a higher tensile strength Of course, 2 to 8° C./sec. can also give satisfactry strength to the wire rod.

Temperature of a wire rod which has been rapidly cooled in the second cooling step ranges preferably from 550° C. to 400° C. If the temperature is higher than 550° C., the recuperation is not satisfactorily restrained and a wire rod with fine pearlite cannot be produced. To obtain a wire rod having mechanical properties better than those of LP patented wire rods, the temperature must be 500° C. or less. But if the wire rod is cooled down to a temperature less than 400° C., an over cooling structure appears. Consequently, 500° C. to 400° C. is preferable. A wire rod finished in the second cooling step has almost completely finished its transformation. Some wire rods produced by continuous casting have segregation in their center portion, and there is possibility that martensite structures are produced. Consequently, it is preferable that wire rods having finished the second cooling step are cooled, at a rate which is as small as possible, as they are naturally left to be cooled. Of course, those wire rods can be reheated to be recuperated or be slowly cooled by use of a slow cooling cover.

In carrying out this second cooling step, it is desirable that construction cost of equipment and facilities are low. Instead of a salt bath or a lead bath, any of the following is taken:

(a) to blast air-blast from below and spray-water from above to a wire rod;

(b) to blast air-blast from below and air-water from above to a wire rod;

(c) to blast to a wire rod air-blast mist which air-blast coming up from below is mixed with spray-water to turn into; and (d) to blast to a wire rod air-blast mist which air-blast coming up from below is mixed with air-water mist to turn into.

Figure 11:
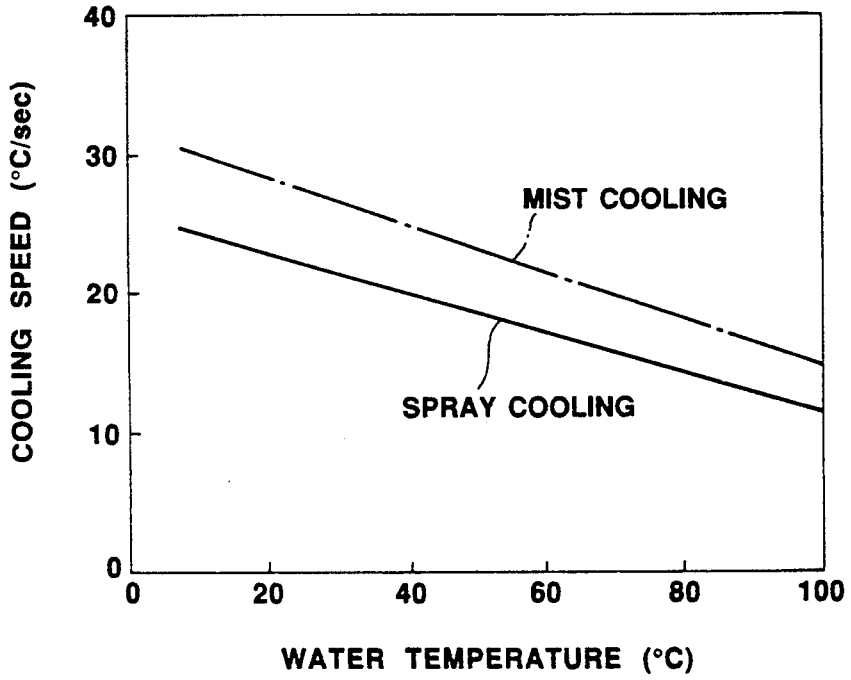
FIG. 11 is a graphic representation showing a relation between water temperature and cooling speed when spray-water cooling and air-water mist cooling are carried out in accordance with the present invention.

In case that water amount used for the foregoing ranges from 10 to 140 $m^3$/hr. The spray-water is blasted from above through a spray nozzle to a wire rod. When air blast from below and spray-water from above are blasted, the water content of the spray water drops into the air-blast and they are mixed of themselves. In case that the air-water mist is used, if air-water mist is made to have an air-to-water ratio of from 5 $Nm^3/m^3$ to 200 $Nm^3/m^3$, homogeneous and large cooling can be procured. Water for spray-water or air-water mist has, in general, a temperature of 15° to 30° C., but not limited to this range, cool water of less than 15° C./sec. or hot water of more than 30° C. can be used. In case of the hot water, its cooling capability is inferior to that of the cooling water, but its blasting force is milder than that of the cool water. FIG. 11 graphically shows relation between water temperature and cooling speed in the spray water cooling and the air-water mist cooling of the present invention.

Transportation of a wire rod is carried out straightforward in a form of continous series of loops which are not non-concentric loops. To make cooling speed of the wire rod more homogeneous, the wire rod is made to advance in a zigzag movement on a conveyer. Due to this zigzag movement, closely overlapped portions of the loops of the wire rod located on both periphery end side portions of the conveyer are made to change their contact position, whereby the cooling of the wire rod become more homogeneous. To have the wire rod advanced in zigzag, the loops are firstly placed flatly on the conveyer. Then, the loops of the wire rod is made to turn to the left and the right by return at every interval of 0.3 to 2.0 of length D in the advancing direction and diagonally relative to the center line of the conveyer and still each center of the loops have a deviation relative to the center line of the conveyer, the deviation being within a maximum range of 0.02 to 0.3 of length D. Length is a diameter of the loops formed by the wire rod.

EXAMPLE-1

Tests for the method of Embodiment-1 were carried out in comparison with Stelmor Patenting Method, Controls, Conventional LP. Wire rods of steel grade SWRH 62B with 5.5 mm in diameter and of steel grade SWRH 82B with 10 mm in diameter were used. The sample wire rod of SWRH 62B has a chemical composition of 0.62 wt.% C, 0.23 wt.% Si, 0.79 wt.% Mn, 0.015 wt.% P and 0.010 wt.% S. The sample wire rod of SWRH 82B has a chemical composition of 0.82 wt.% C, 0.22 wt.% Si, 0.80 wt.% Mn, 0.012 wt.% P and 0.008% S. Table 1 shows test conditions in case of SWRH 62B steel being used and Table 2 shows test conditions in case of SWRH 82B being used. In Tables 1 and 2, Test Nos., methods, starting temperatures for rapid cooling, water flow and air-to-water ratio for air-water mist from above, water flow and air-to-water ratio for air-water mist from below, blasting speed, conveyer speed, rapid cooling time, heat treatment after rapid cooling. Nos. 1 and 6 are cases of Stelmor Method; Nos. 2 and 7 of Controls wherein sample rods are cooled exclusively by air-water mist blast from above; Nos. 3 and 8 of Controls wherein sample rods are cooled by air blast from below and by air-water mist blast coming through mist nozzles placed in blast boxes; Nos. 4 and 9 of the present invention wherein sample rods are cooled by mist blast from below and by air blast from below; and Nos. 5 and 10 of conventional LP.

Tables 3 and 4 show the results of those tests. Temperatures of those sample wire rods were measured in respect with thick portions of the sample wire rods by radiation thermometers. Tensile test was done by measuring 24 divided points of three loops of each of the sample wire rods, the three loops being located at the top end, the center and the tail end of the wire rods on the conveyer. Structures of the sample rods were observed by an optical microscope, the sample rods having been corroded by 2% Nital. P represents pearlite and F ferrite.

As shown in Tables 3 and 4, Nos. 1 and 6 in accordance with Stelmor Method show the cooling speed is small. Due to this slow speed, the strength is remarkably low. In contrast, in the cases of Nos. 2 and 7 wherein the air blast from below were not given, or in the cases of Nos. 3 and 8 wherein the air-water mist blasting from below was exclusively done, the strength of the sample rods matches satisfactorily that of the LP patented rods of Nos. 5 and 10, but the deviation of the strength (maximum value-minimum value) is considerably large. In the cases of Nos. 4 and 9 which are the examples of the present invention, however, the deviation of the strength of the sample rods are small and furthermore, the drawability of the rods is better than that of the LP patented rods. This is because in applying LP treatment to the sample rods, they are reheated up to 900° C. or more and their austenite grains are coarsened so much that pearlite colonies which are produced after the transformation become large and resultantly, the drawability is deteriorated.

Figure 12:
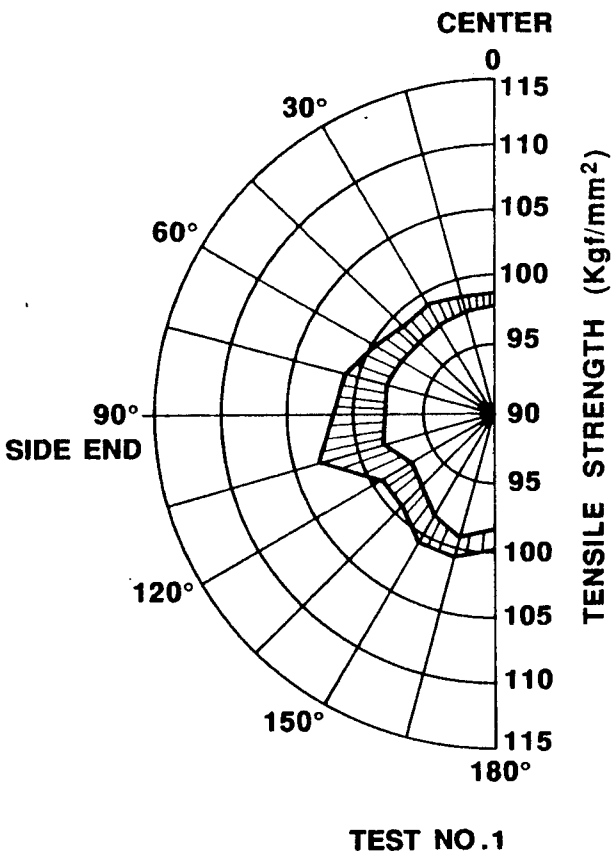
FIG. 12 is a graphic representation showing deviation of strength of semi-circle loops of Example-1 of the present invention, depending of positions.
Figure 12:
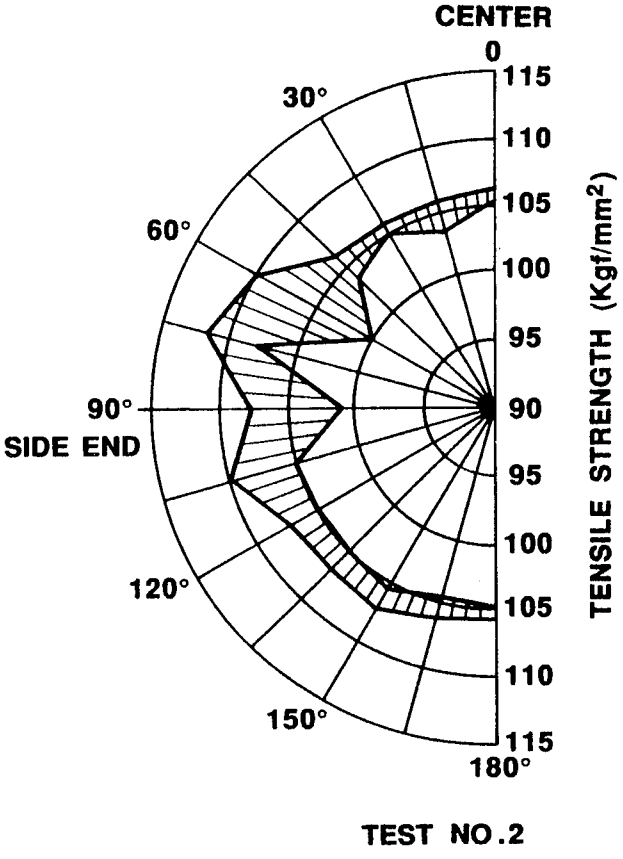
Figure 12:
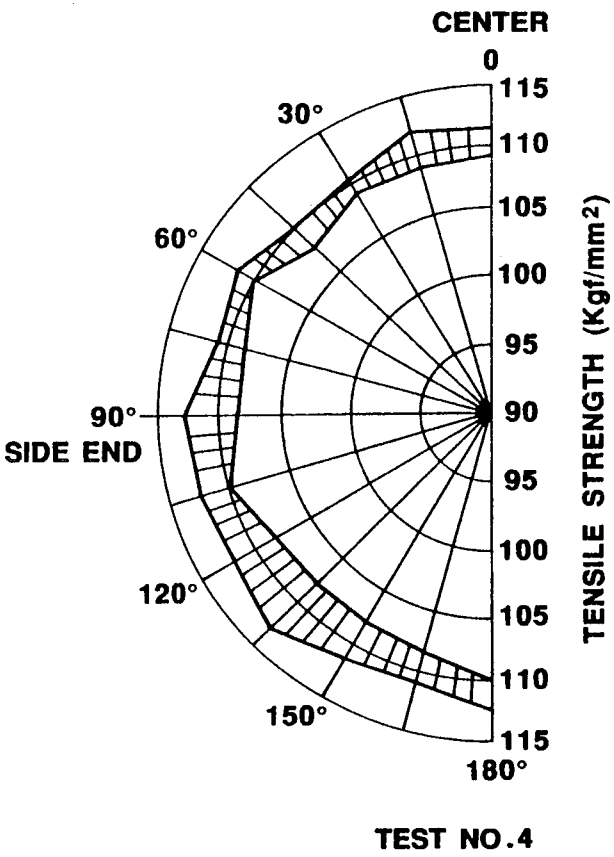
Figure 12:
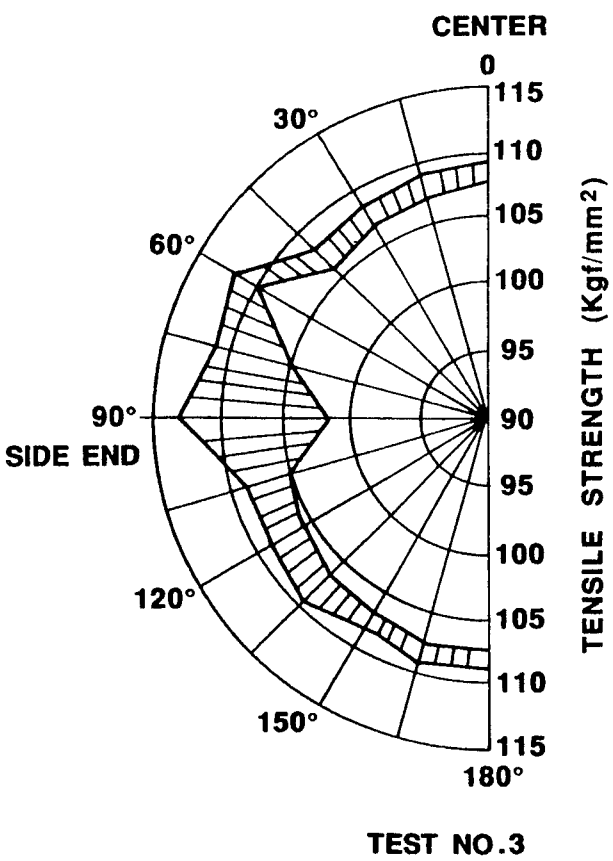

FIG. 12 shows the distribution of the strength of the sample rods in the cases of Test Nos. 1, 2, 3 and 4 in a semi-circle of the loops taken from the sample rods. 0° and 180° represent the points of the center line of the conveyer and 90° is an end side of the conveyer where the loops of the rods are most over lapped. As seen from Test Nos. 3 and 4, the distribution of the strenth are concentrated in the vicinity of the end side and here in this area, the maximum and minimum values of the strength are perceived. Namely, even if the rapid cooling is carried out on one side surface of the sample rod, a portion of the surface which is hit by the mist blasting has high strength, while the other portion of the other side surface which is not hit by the mist blast has low strength because of the lack of cooling. Resultantly, the structure of the portion with high strength has fine pearlite, and the structure of the portion with low strength has coarse pearlite mixed partially with ferrite. Therefore, in the portion of low strength, the ductility is also low. In contrast, in case of the sample rod of Test No. 4 which is an example of the present invention, even the thick portion of the rod can be cooled homogeneoursly from both above and below, and the deviation of the strength is reduced so remarkably that the structure comprise wholly fine pearlite and the ductility also becomes well.

Now, the results of tests will be described, wherein water amount of the air-mist, water amount of the mist and air-to-water ratio and cooling method after the rapid cooling varied in detail. Tables 5 and 6 shows conditions of the tests and Tables 7 and 8 show the results of the tests. M represents martensite.

For Tests Nos. 11 through 23, wire rods of steel SWRH 62B and with 5.5 mm in diameter were used. For Tests Nos. 24 through 36, wire rods of steel SWRH 62B and with 5.5 mm in diameter were used. Test Nos. 11 and 24 are cases of the conventional Stelmor Method and show low strength as well as low ductility and have a coarse pearlite structure.

In Test Nos. 12 and 25, water amount was short and air-to-water ratio was large. Due to this, the sample rods were not rapidly cooled down to 550° C. or less the strength as well as the ductility are low.

In Test Nos. 13, 15, 18, 26, 28, and 31, the cooling was carried out by spray water without supplying air, and the air blast was so weak as to be 40 m/sec. and 30 m/sec. Resultantly, the water particles were not uniformly distributed and the cooling was ill-balanced, and therefore, martensite was partially produced. Because of this the deviation of the strength and the ductility is large.

Test Nos. 14, 17, 20, 27, 30, and 33 are examples of the present invention. Because the appropriate rapid cooling and heat treatment after the cooling was carried out, the strength as well as the ductility are well and furthermore, the deviations of them are small.

In Test Nos. 16, 19, 29 and 32, the wire rods were merely cooled by leaving the wire rods as they were after the rapid cooling was done. In these cases, martensite is partially produced and the deviation of the strength and the ductility are large.

In Test Nos. 21 and 34, there was too much water used in the cooling. The martensite appeared almost wholly in the structure. The ductility is completely lost.

In carrying Test Nos. 22 and 35 which are the examples of the present invention, air-water mist was mixed in advance with air blast through nozzles placed in an air blast box. The sample rods of these cases have high strength and high ductility and have small deviation as those of Test Nos. 17 and 30.

Test Nos. 23 and 36 are examples of the conventional LP. The strength and the deviation are good but the ductility is inferior to that of the examples of the present invention.

Test No. 37 is an example wherein the cooling was carried out with small amount of water and high air-to-water ratio at high speed blasting of air-blast. Thanks to effect of air-blast made from above to the samples, good results were marked.

Test No. 38 is an example wherein the cooling was carried out with large amount of water and low speed blasting of air-blast. Good results were marked.

Test No. 39 is an example wherein the cooling was carried out with air-to-water ratio being zero and at high speed blasting of air-blast. Thanks to air blast, spray water was uniformly and finely distributed to have the cooling homogeneous. Good results was obtained.

Test No. 40 is an example wherein the recuperation of Test No. 39 in the second cooling step was replaced by slow cooling. This example suggests that good results can be obtained even by means of slow cooling if reasonable attention is paid.

TABLE 1

| No. | Method | Start Temp. of Rapid Cooling °C. | Air-Water Mist from Above: Water Flow l/min | Air-Water Mist from Above: Air-Water Ratio $Nm^3/m^3$ | Air-Water Mist from Below: Water Flow l/min | Air-Water Mist from Below: Air-Water Ratio $Nm^3/m^3$ | Air Blast (Speed) m/sec | Conveyer (Speed) m/min | Rapid Cooling Time sec | Heat Treatment after Rapid Cooling: Method | Heat Treatment after Rapid Cooling: Speed °C./sec |
|---|---|---|---|---|---|---|---|---|---|---|---|
| 1 | Stelmor | 840 | — | — | — | — | 42 | 40 | 26 | Natural Cooling | 3 |
| 2 | Control | 840 | 1500 | 42.1 | — | — | 0 | 40 | 13 | Slow Cooling | 0.5 |
| 3 | Control | 840 | — | — | 1300 | 16.1 | 42 | 40 | 13 | Slow Cooling | 0.5 |
| 4 | Present Invention | 840 | 1500 | 42.1 | — | — | 42 | 40 | 13 | Slow Cooling | 0.5 |
| 5 | Prior Art LP | Rapid Cooling by 530° C. Lead Bath after Heating up to 950° C. | | | | | | | | | |

TABLE 2

| No. | Method | Start Temp. of Rapid Cooling °C. | Air-Water Mist from Above: Water Flow l/min | Air-Water Mist from Above: Air-Water Ratio $Nm^3/m^3$ | Air-Water Mist from Below: Water Flow l/min | Air-Water Mist from Below: Air-Water Ratio $Nm^3/m^3$ | Air Blast (Speed) m/sec | Conveyer (Speed) m/min | Rapid Cooling Time sec | Heat Treatment after Rapid Cooling: Method | Heat Treatment after Rapid Cooling: Speed °C./sec |
|---|---|---|---|---|---|---|---|---|---|---|---|
| 6 | Stelmor | 840 | — | — | — | — | 42 | 33 | 32 | Natural Cooling | 2.5 |
| 7 | Control | 840 | 1600 | 39.5 | — | — | 0 | 33 | 16 | Recuperation | 0.5 |
| 8 | Control | 840 | — | — | 1500 | 14.0 | 42 | 33 | 16 | Recuperation | 1.0 |
| 9 | Present Invention | 840 | 1600 | 39.5 | — | — | 42 | 33 | 16 | Recuperation | 1.0 |
| 10 | Prior Art LP | Rapid Cooling by 525° C. Lead Bath after Heating up to 980° C. | | | | | | | | | |

TABLE 3

| No. | Method | Average Cooling Speed °C./sec | Average Temp. after Rapid Cooling °C. | Tensile Strength $kgf/mm^2$: Average | Tensile Strength: Max. | Tensile Strength: Min. | Tensile Strength: Deviation | Drawability %: Average | Drawability: Max. | Drawability: Min. | Drawability: Deviation | Structure |
|---|---|---|---|---|---|---|---|---|---|---|---|---|
| 1 | Stelmor | 11 | 554 | 99 | 103 | 97 | 6 | 62 | 64 | 56 | 8 | Coarse P + F |
| 2 | Control | 23 | 541 | 106 | 112 | 100 | 12 | 63 | 66 | 58 | 8 | Fine P + Coarse P + F |
| 3 | Control | 24 | 528 | 107 | 113 | 102 | 11 | 63 | 67 | 60 | 7 | Fine P + Coarse P + F |
| 4 | Present Invention | 28 | 476 | 111 | 113 | 108 | 5 | 64 | 67 | 63 | 4 | Fine P |
| 5 | Prior Art LP | 27 | 530 | 108 | 110 | 106 | 4 | 60 | 63 | 58 | 5 | Fine P |

TABLE 4

| No | Method | Average Cooling Speed °C./sec | Average Temp. after Rapid Cooling °C. | Tensile Strength kgf/mm² Average | Max. | Min. | Deviation | Drawability % Average | Max. | Min. | Deviation | Structure |
|---|---|---|---|---|---|---|---|---|---|---|---|---|
| 6 | Stelmor | 9 | 552 | 114 | 117 | 109 | 8 | 45 | 48 | 41 | 7 | Coarse P |
| 7 | Control | 20 | 520 | 126 | 130 | 120 | 10 | 47 | 49 | 42 | 7 | Fine P + Coarse P |
| 8 | Control | 21 | 504 | 128 | 131 | 122 | 9 | 47 | 50 | 41 | 9 | Fine P + Coarse P |
| 9 | Present Invention | 24 | 456 | 130 | 132 | 128 | 4 | 48 | 50 | 45 | 5 | Fine P |
| 10 | Prior Art LP | 23 | 525 | 124 | 126 | 122 | 4 | 40 | 43 | 38 | 5 | Fine P |

TABLE 5(a)

| No. | Method | Start Temp. of Rapid Cooling °C. | Mist from Above Water Flow l/min | Mist from Above Air-to-Water Ratio Nm³/m³ | Mist from Below Water Flow l/min | Mist from Below Air-to-Water Ratio Nm³/m³ |
|---|---|---|---|---|---|---|
| 11 | Stelmor | | — | — | — | — |
| 12 | Control | | 190 | 332.3 | — | — |
| 13 | Control | | 700 | 0 | — | — |
| 14 | Present Invention | | 700 | 90.2 | — | — |
| 15 | Control | | 1200 | 0 | — | — |
| 16 | Control | | 1200 | 52.6 | — | — |
| 17 | Present Invention | 860 | 1200 | 52.6 | — | — |
| 18 | Control | | 1700 | 0 | — | — |
| 19 | Control | | 1700 | 37.1 | — | — |
| 20 | Present Invention | | 1700 | 37.1 | — | — |
| 21 | Control | | 2500 | 25.3 | — | — |
| 22 | Present Invention | | 1200 | 52.6 | 300 | 70.0 |
| 23 | Prior Art LP | Rapid Cooling by 530° C. Lead Bath after heating up to 960° C. | | | | |

TABLE 5(b)

| No. | Air-Blast Speed m/sec | Conveyer Speed m/min | Rapid Cooling Time sec | Heat Treatment after Rapid Cooling Method | Speed °C./sec |
|---|---|---|---|---|---|
| 11 | 40 | 30 | 34 | Natural Cooling | 3 |
| 12 | 40 | 30 | 17 | Slow Cooling | 1.5 |
| 13 | 40 | 30 | 17 | Slow Cooling | 1.5 |
| 14 | 40 | 30 | 17 | Slow Cooling | 1.5 |
| 15 | 40 | 30 | 17 | Recuperation | 1.5 |
| 16 | 40 | 30 | 17 | Natural Cooling | 3 |
| 17 | 40 | 30 | 17 | Repecuration | 1.5 |
| 18 | 40 | 40 | 13 | Repecuration | 1.5 |
| 19 | 40 | 40 | 13 | Natural Cooling | 3 |
| 20 | 40 | 40 | 13 | Repecuration | 1.5 |
| 21 | 40 | 40 | 13 | Repecuration | 1.5 |
| 22 | 40 | 30 | 17 | Repecuration | 1.5 |
| 23 | Rapid Cooling by 530° C. Lead Bath after Heating up to 960° C. | | | | |

TABLE 6(a)

| No. | Method | Start Temp. of Rapid Cooling °C. | Mist from Above Water Flow l/min | Mist from Above Air-Water Ratio Nm³/m³ | Air-Water Mist from Below Water Flow l/min | Air-Water Mist from Below Air-Water Ratio Nm³/m³ |
|---|---|---|---|---|---|---|
| 24 | Stelmor | | — | — | — | — |

TABLE 6(a)-continued

| No. | Method | Start Temp. of Rapid Cooling °C. | Mist from Above Water Flow l/min | Mist from Above Air-Water Ratio Nm³/m³ | Air-Water Mist from Below Water Flow l/min | Air-Water Mist from Below Air-Water Ratio Nm³/m³ |
|---|---|---|---|---|---|---|
| 25 | Control | | 190 | 332.3 | — | — |
| 26 | Control | | 700 | 0 | — | — |
| 27 | Present Invention | | 700 | 90.2 | — | — |
| 28 | Control | | 1200 | 0 | — | — |
| 29 | Control | | 1200 | 52.6 | — | — |
| 30 | Present Invention | 850 | 1200 | 52.6 | — | — |
| 31 | Control | | 1700 | 0 | — | — |
| 32 | Control | | 1700 | 37.1 | — | — |
| 33 | Present Invention | | 1700 | 37.1 | — | — |
| 34 | Control | | 2500 | 25.3 | — | — |
| 35 | Present Invention | | 1200 | 52.6 | 300 | 70.0 |
| 36 | Prior Art LP | Rapid Cooling by 540° C. Lead Bath after Heating up to 960° C. | | | | |
| 37 | Present Invention | 850 | 500 | 180 | — | — |
| 38 | Present Invention | 850 | 2400 | 24 | — | — |
| 39 | Present Invention | 850 | 1200 | 0 | — | — |
| 40 | Present Invention | 850 | 1200 | 0 | — | — |

TABLE 6(b)

| No. | Air-Blast Speed m/sec | Conveyer Speed m/min | Rapid Cooling Time sec | Heat Treatment after Rapid Cooling Method | Speed °C./sec |
|---|---|---|---|---|---|
| 24 | 30 | 40 | 26 | Natural Cooling | 3.0 |
| 25 | 30 | 40 | 13 | Slow Cooling | 1.5 |
| 26 | 30 | 40 | 13 | Slow Cooling | 1.5 |
| 27 | 30 | 40 | 13 | Slow Cooling | 1.5 |
| 28 | 30 | 40 | 13 | Recuperation | 1.5 |
| 29 | 30 | 40 | 13 | Natural Cooling | 3 |
| 30 | 30 | 40 | 13 | Recuperation | 1.5 |
| 31 | 30 | 50 | 11 | Recuperation | 1.5 |
| 32 | 30 | 50 | 11 | Natural Cooling | 3 |
| 33 | 30 | 50 | 11 | Recuperation | 1.5 |
| 34 | 30 | 50 | 11 | Recuperation | 1.5 |
| 35 | 30 | 40 | 13 | Recuperation | 1.5 |
| 36 | Rapid Cooling by 540° C. Lead Bath after Heating up to 960° C. | | | | |
| 37 | 60 | 40 | 22 | Slow Cooling | 1.5 |
| 38 | 10 | 40 | 8 | Recuperation | 1.5 |
| 39 | 60 | 40 | 11 | Recuperation | 1.5 |

TABLE 6(b)-continued

| No | Air-Blast Speed m/sec | Conveyer Speed m/min | Rapid Cooling Time sec | Heat Treatment after Rapid Cooling Method | Heat Treatment after Rapid Cooling Speed °C./sec |
|---|---|---|---|---|---|
| 40 | 60 | 40 | 10 | Slow Cooling | 1.5 |

TABLE 7(a)

| No. | Method | Average Cooling Speed °C./sec | Average Temp. after Rapid Cooling °C. | Tensile Strength kgf/mm² Average | Max. | Min. | Deviation |
|---|---|---|---|---|---|---|---|
| 11 | Stelmor | 8 | 588 | 93 | 97 | 90 | 7 |
| 12 | Control | 13 | 639 | 92 | 96 | 89 | 7 |
| 13 | Control | 20 | 520 | 103 | 125 | 99 | 26 |
| 14 | Present Invention | 20 | 520 | 101 | 104 | 99 | 5 |
| 15 | Control | 23 | 469 | 106 | 121 | 100 | 21 |
| 16 | Control | 23 | 469 | 125 | 138 | 99 | 39 |
| 17 | Present Invention | 23 | 469 | 103 | 106 | 100 | 6 |
| 18 | Control | 32 | 444 | 109 | 129 | 104 | 25 |
| 19 | Control | 32 | 444 | 135 | 145 | 105 | 40 |
| 20 | Present Invention | 32 | 444 | 105 | 108 | 103 | 5 |
| 21 | Control | 51 | 197 | 144 | 162 | 131 | 31 |
| 22 | Present Invention | 26 | 418 | 104 | 108 | 101 | 7 |
| 23 | Prior Art LP | 20 | 530 | 104 | 107 | 100 | 7 |

TABLE 7(b)

| No. | Drawability % Average | Max. | Min. | Deviation | Structure |
|---|---|---|---|---|---|
| 11 | 52 | 54 | 49 | 5 | Coarse P |
| 12 | 51 | 54 | 49 | 6 | Coarse P |
| 13 | 54 | 57 | 47 | 10 | Fine P + M |
| 14 | 55 | 58 | 52 | 6 | Fine P |
| 15 | 54 | 59 | 41 | 18 | Fine P + M |
| 16 | 49 | 58 | 1 | 57 | Fine P + M |
| 17 | 57 | 60 | 55 | 5 | Fine P |
| 18 | 50 | 58 | 25 | 33 | Fine P + M |
| 19 | 45 | 59 | 0 | 59 | Fine P + M |
| 20 | 58 | 60 | 54 | 6 | Fine P |
| 21 | 1 | 3 | 0 | 3 | M |
| 22 | 58 | 61 | 55 | 6 | Fine P |
| 23 | 50 | 54 | 47 | 7 | Fine P |

TABLE 8(a)

| No. | Method | Average Cooling Speed °C./sec | Average Temp. after Rapid Cooling °C. | Tensile Strength kgf/mm² Average | Max. | Min. | Deviation |
|---|---|---|---|---|---|---|---|
| 24 | Stelmor | 10 | 590 | 120 | 125 | 116 | 9 |
| 25 | Control | 17 | 629 | 118 | 123 | 114 | 9 |
| 26 | Control | 26 | 512 | 132 | 147 | 125 | 22 |
| 27 | Present Invention | 26 | 512 | 129 | 133 | 125 | 8 |
| 28 | Control | 29 | 473 | 139 | 150 | 128 | 22 |
| 29 | Control | 29 | 473 | 140 | 163 | 129 | 24 |
| 30 | Present Invention | 29 | 473 | 131 | 133 | 128 | 5 |
| 31 | Control | 38 | 432 | 149 | 177 | 135 | 42 |
| 32 | Control | 38 | 432 | 151 | 173 | 130 | 43 |
| 33 | Present Invention | 38 | 432 | 134 | 137 | 131 | 6 |
| 34 | Control | 55 | 245 | 161 | 187 | 141 | 46 |
| 35 | Present Invention | 32 | 434 | 132 | 134 | 129 | 5 |

TABLE 8(a)-continued

| No. | Method | Average Cooling Speed °C./sec | Average Temp. after Rapid Cooling °C. | Tensile Strength kgf/mm² Average | Max. | Min. | Deviation |
|---|---|---|---|---|---|---|---|
| 36 | Prior Art LP | 26 | 540 | 128 | 130 | 124 | 6 |
| 37 | Present Invention | 14 | 542 | 125 | 128 | 122 | 6 |
| 38 | Present Invention | 48 | 466 | 131 | 134 | 128 | 6 |
| 39 | Present Invention | 31 | 509 | 132 | 133 | 126 | 7 |
| 40 | Present Invention | 31 | 540 | 124 | 127 | 120 | 7 |

TABLE 8(b)

| No. | Drawability % Average | Max. | Min. | Deviation | Structure |
|---|---|---|---|---|---|
| 24 | 46 | 50 | 40 | 10 | Coarse P |
| 25 | 44 | 48 | 39 | 9 | Coarse P |
| 26 | 48 | 55 | 41 | 14 | Fine P + M |
| 27 | 52 | 54 | 49 | 5 | Fine P |
| 28 | 47 | 55 | 40 | 15 | Fine P + M |
| 29 | 38 | 54 | 2 | 52 | Fine P + M |
| 30 | 54 | 56 | 51 | 5 | Fine P |
| 31 | 33 | 55 | 1 | 54 | Fine P + M |
| 32 | 37 | 53 | 0 | 53 | Fine P + M |
| 33 | 52 | 54 | 48 | 6 | Fine P |
| 34 | 1 | 2 | 0 | 2 | M |
| 35 | 54 | 56 | 52 | 4 | Fine P |
| 36 | 46 | 50 | 43 | 7 | Fine P |
| 37 | 48 | 52 | 46 | 6 | Fine P |
| 38 | 52 | 55 | 50 | 5 | Fine P |
| 39 | 50 | 53 | 47 | 6 | Fine P |
| 40 | 46 | 49 | 42 | 7 | Fine P |

EXAMPLE-2

Tests were carried out in accordance with the method described in Preferred Embodiment-2. The sample wire rods used for the test were those with steel of SWRH62B, of SWRH82B and of high Si and low Mn which is stronger in strength than SWRH82B. The chemical composition is shown in Table 9.

Test conditions are shown in Table 10. The results thereof using SWRH 62B and SWRH 82B are shown respectively in Tables 11 and 12. The temperature of starting the cooling was 840° C. The first cooling zone and the second cooling zone both were 1600 mm wide and 9000 mm long.

No. 1 is an ordinary cooling wherein air blast is exclusively carried out. Its cooling speed is small and the temperatures at the time when the first cooling was finished and when the second cooling was finished were high.

The strength and ductility of the wire rods produced under this condition are low.

No. 2 is a method of the present invention wherein in the first cooling step spray-water was blasted from above and air-blast was blasted from below to a wire rod and in the second cooling step the air-blast was exclusively blasted. In the first cooling step, the air-blast was mixed naturally with water dropping from above and actually turned to be air blast mist. The temperatures when the first cooling step was over and the second cooling step was over were respectively 498° C.

and 444° C. and thereafter cooling was slowly carried out at a rate of 15° C./ sec. Thanks to this process, the pearlite structure, thus obtained, is fine and the strength and ductility of the obtained wire rods are high.

No. 3 is a method similar to No. 2, but the transportation speed was fast and resultantly, the cooling time was short and the temperatures at the ends of the first and the second cooling step were higher. Thanks to this modification of the process, the strength and ductility of this test are a little higher than those of No. 1.

In case of No. 4, contrarily, the temperatures at the ends of the first and the second cooling step were too low, and therefore, bainite was partially produced in the structure of the product. The strength is high, but the ductility is low and the deviation is large. In case of No. 5, the temperature at the end of the first cooling step was rather high to be 587° C., but the temperature was cooled at 12° C./sec. with parallel use of the spray-water down to 456° C. The obtained structure and mechanical properties are inferior to those obtained through No. 2, but they have good features.

In case of No. 6, the first cooling step was carried out solely by spray-water. But, the air blast was not parallelly employed, and consequently, the cooling speed was smaller than that of No. 4. The strength and ductility are better than those of No. 1.

In case of No. 7, the temperature at the end of the first cooling step was a little high and in addition, the cooling was slowly done at a rate of 1.5° C./sec. in the second cooling step. The temperature at the end of the second cooling step was high. Because of these operational conditions, the features of the produced wire rods are not satisfactory.

In case of No. 8, the sample rod was somewhat excessively cooled, and thereafter recuperation treatment at a rate of 2° C./sec. was carried out. There is no appearance of bainite and fine pearlite structure is produced.

In case of No. 9, upto the second cooling step, a method was same with Test No. 2, and thereafter, the sample rod was rapidly cooled at a rate of 7° C./sec. In the segregation portion in the center of the wire rod, a slight amount of martensite was produced.

In case of No. 10, without blasting from above, the wire rod was cooled by mist blast which was a mixture of air blast with water through spray nozzles placed in a blast chamber. The cooling temperature was appropriate and the features equivalent to those of No. 2 are obtained.

In case of No. 11, this was carried out in accordance with an off line lead patenting method. The strength of the produced rod is high, but the ductility is inferior to that of No. 2 or 9, because of the growth of austenite grains due to reheating.

No. 12 is an example wherein cooling was carried out by having water of 20 $m^3$/hr. turn into fine particles by means of blasting through high speed air blast at a rate of 60 m/sec. No. 13 is an example wherein cooling was carried out by having water of 140 $m^3$/hr. turn into fine particles by means of blasting high air blast at a rate of 60 mt/sec. No. 14 shows an example of high air-to-water ratio which was 170 $Nm^3/m^3$ and adding water of 10 $Nm^3$/hr. to an air-blast coming up from below the wire rod. In No. 15, cooling was carried out by blasting spray water of 120 $m^3$/hr. to a wire rod from above. No. 16, the first cooling was done for 7 sec. by increasing speed of the conveyer. In Nos. 12 through 16, it is shown that good results could be obtained when the sample wire rods of steel SWRH 62B were used. Even cases of Nos. 6, 10 and 15 wherein the one side cooling was carried out, the good results were obtained. This is because a wire rod was made to advance in the zigzag movement thereby to have the wire rod homogeneously cooled.

Figure 13:
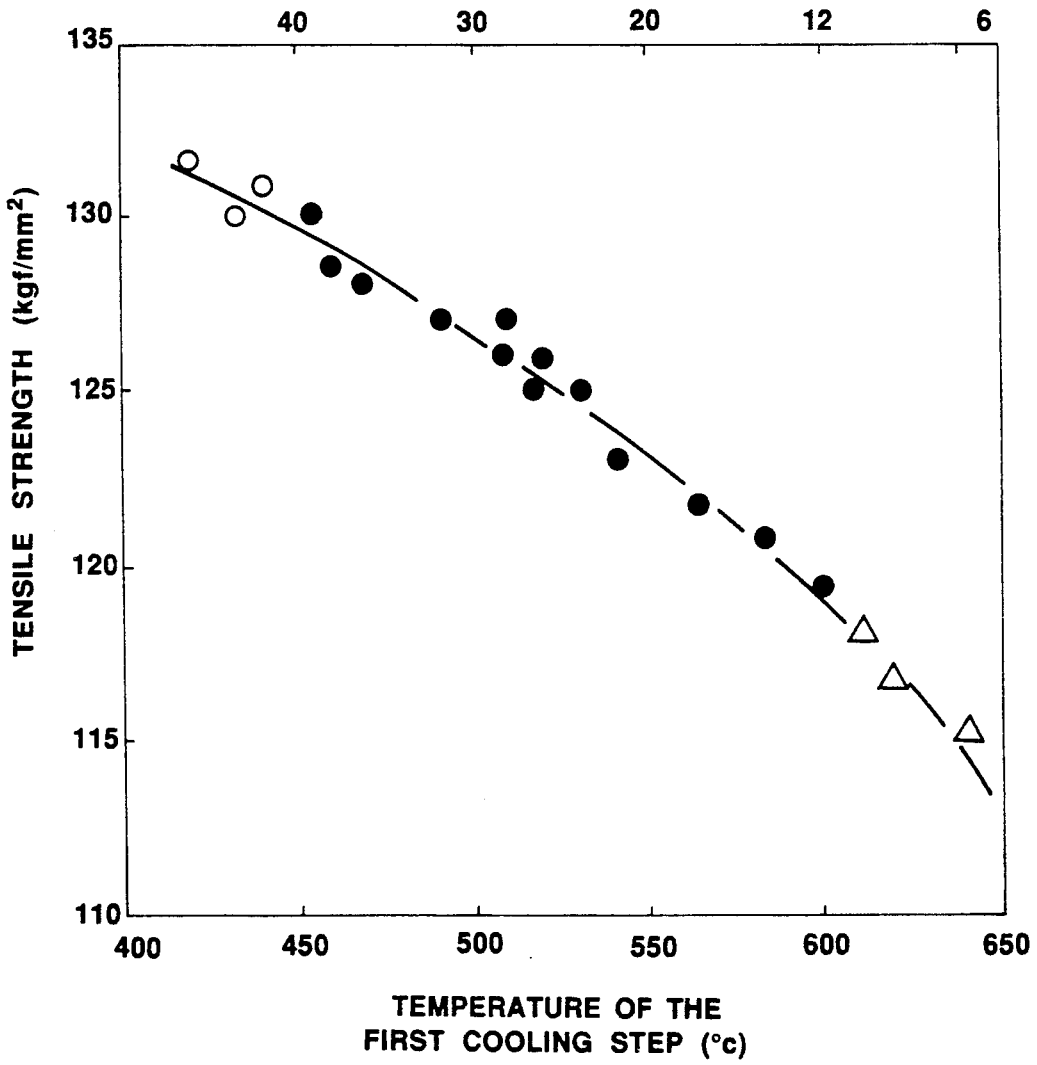
FIG. 13 is a graphic representation showing relation between cooling temperature and strength of a wire rod in the first cooling step of the present invention.

FIG. 13 graphically shows relation between temperature and tensile strength when a sample wire rod of SWRH 82B with 9 mm in diameter was used, the temperature is at the time when the first cooling step was finished. In the second cooling step air blast at a rate of 4° C./sec. was applied to the sample rod. Symbol mark "○" indicates bainite structures, symbol mark "●" fine pearlite structures and symbol mark "Δ" coarse pearlite structures. Wire rods which are cooled by air blast have, in general, about 115 kg f/$mm^2$ tensile strength, but by means of controlling the temperature of the first cooling step to have the temperature range 600° C. to 450° C., a wire rod having a tensile strength of 119 kgf/$mm^2$ to 130 kgf/$mm^2$ can be produced.

Figure 14:
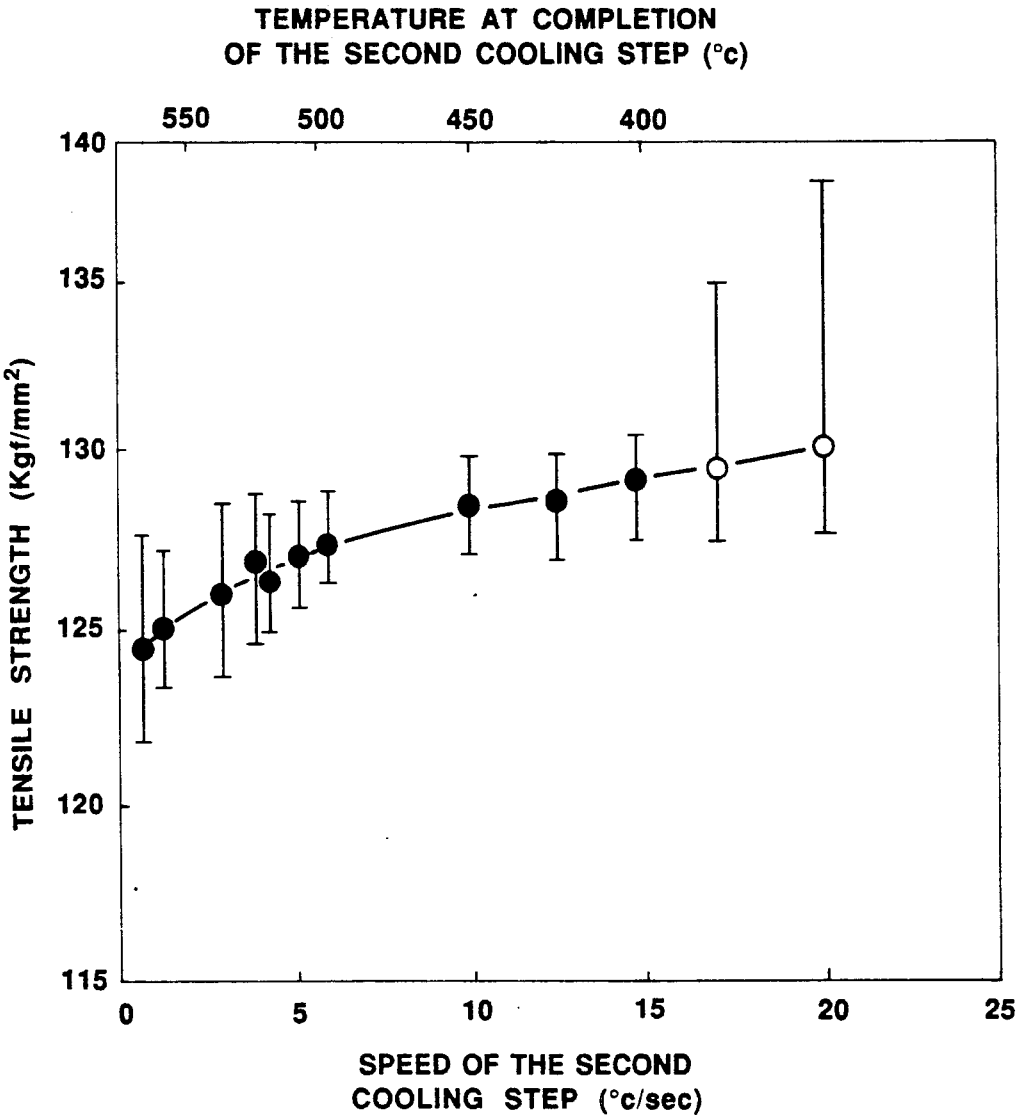
FIG. 14 is a graphic representation showing relation between cooling temperature and strength of a wire rod in the second cooling step of the present invention.

FIG. 14 graphically shows a relation between temperature of the first cooling step and cooling speed of the second cooling step, the temperature being 575° C. at the time the first cooling step and the cooling speed varying. In the graph, symbol mark "○" indicate bainite structures and symbol mark "●" fine pearlite structures. By using a cooling speed of 2° C./sec. to 15° C./sec. a wire rod with a high tensile strength can be obtained, but if the speed is over 15°C./sec., it is not desirable because bainite structures appear and the deviation of the tensile strength becomes large.

Table 13 shows the test results of wire rods with high Si-low Mn steel A. It is shown that the features of No. 2 of the present invention are better than those of No. 1 of the air blast cooling and those of No. 9 of the off line lead patenting.

As mentioned above, in accordance with the present invention, a wire rod with features equivalent to or exceeding those of a wire rod which is produced by an off line lead patenting method can be obtained without using a special heating apparatus after the rapid cooling.

Tables 14 and 15 show the results of the method of the first cooling step and the second cooling step, wherein a wire rod was transported in the manner of having the wire rod advanced in zigzag. The results given in Table 14 are when steel of SWRH 62B was used and those in Table 15 are given when steel of SWRH 82B was used. The test conditions correspond to those given Nos. in Table 10. The zigzag movement of a wire rod was carried out in the manner that guide materials in which plurality of rotar units were incorporated were placed along side walls on both sides of the conveyer running in the direction of the wire rod and the rod was made to advance, turning to the left and the right by turn every 800 mm diagonally relative to the center line of the conveyer and having each center of the loops. Of the wire rod have a maximum deviation 80 mm relative to the center of the conveyer. By this zigzag movement, soft quality points remaining in the thick portion of the wire rod were removed and the deviation of strength was reduced.

Figure 15:
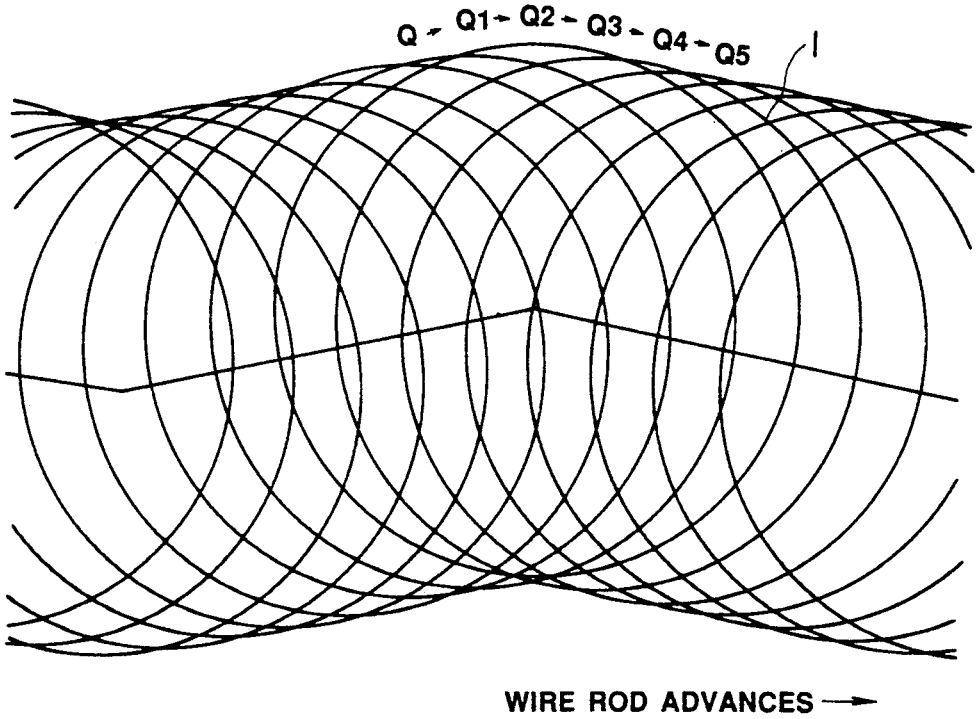
FIG. 15 is a schematic conceptual plan view showing a zigzag movement of a wire rod of the present invention.

FIG. 15 schematically shows a conceptual plan view of a zigzag movement of a wire rod in a form of continuous series of loops in accordance with the present invention. The wire rod in a form of continuous series of loops is gradually pushed diagonally relative to the advancing direction of the wire rod. To have the wire rod pushed, guide frame materials in which a roller vertically standing is incorporated are placed alternately along both side walls of the conveyer. The interval of placement of the guide frame materials ranges preferably between 0.3 to 2.0 of length D which is a diameter of the loops of the wire rod. If the interval is less than 0.2 D, it is not desirable because transportation resistance against the zigzag movement becomes large, while if it is over 2.0 D, the frequency of the zigzag movement becomes undesirably low. In addition, length of the pushing is recommended to be between 0.02 to 0.3 D. If the length is less than 0.02 D, it is impossible to have each of the loops moved diagonally toward each of the frame materials on both side of the conveyer to the extent that it is desired and consequently, the wire rod fails to be homogeneously cooled. If it is over 0.3 D, it is disadvantageous because the transportation resistance against the zigzag movement is increased and the conveyer having a broad width must be used. Point Q in FIG. 15 at which one of the loops is in contact with the other is constantly forwarding in zigzag in the direction of $Q_1 \rightarrow Q_2$, changing its location.

Figure 16:
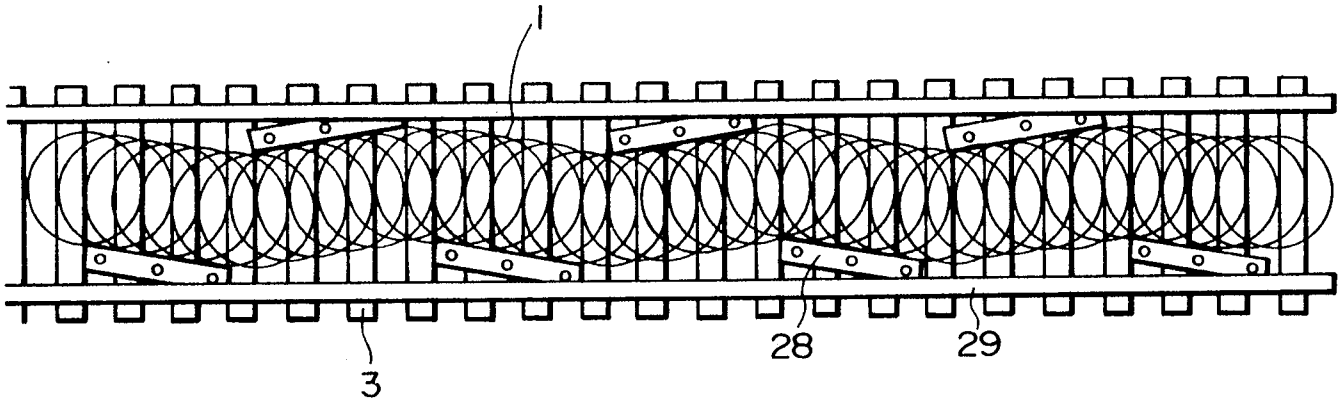
FIG. 16 is a schematic plane view of an apparatus for the zigzag movement of the wire rod of the present invention.
Figure 17:
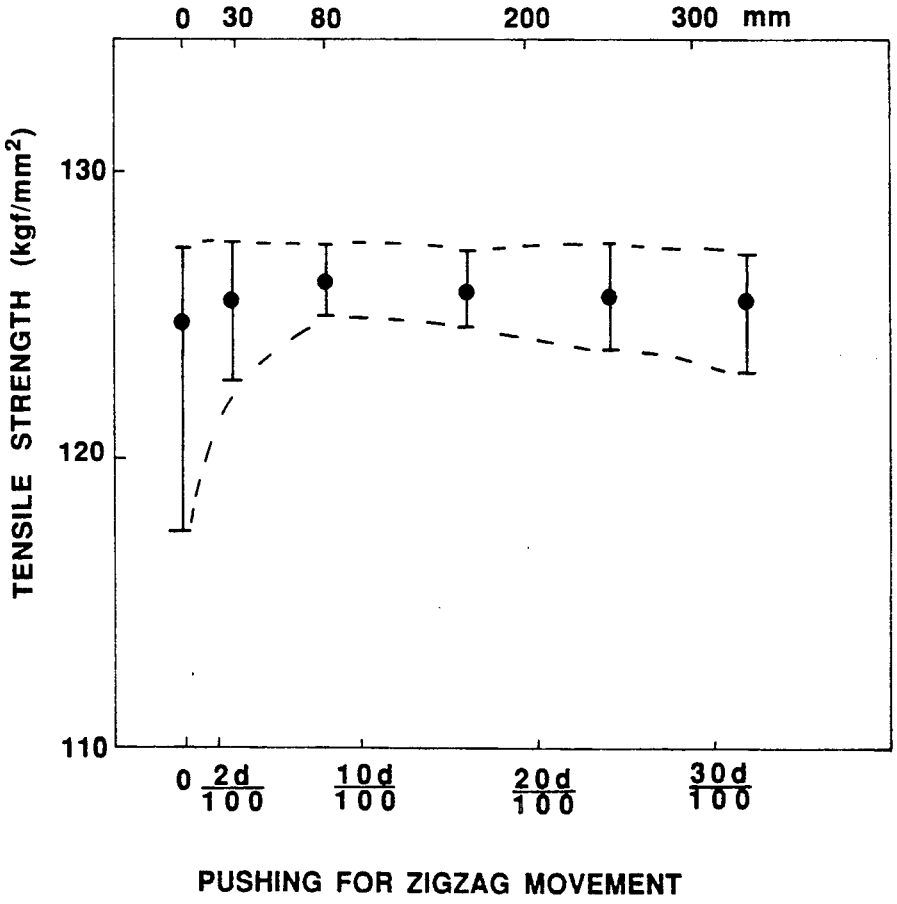
FIG. 17 is a relation between pushing of a wire rod and strength thereof in the zigzag movement of the present invention.

FIG. 16 shows a plan view of an apparatus used for the zigzag movement of the wire rod of the present invention. Referential numeral 28 denotes guide frame materials and 29 side walls of the conveyer. The wire rod is guided are guided by guide frame materials 28, and advances, making a zigzag movement. FIG. 17 graphically shows relation between pushing of a wire rod and strength of the wire rod in the zigzag movement, length of the pushing varying. The diameter of the loops is 1050 mm. 30 mm length pushing work contributes to having the deviation of the strength reduced to about one half of that of cooling without using the zigzag movement. The effect of the pushing work becomes optimum when the length is 80 mm. If the length is over 80 mm, the transportation resistance becomes so large that the loops of the wire rod is choked on the way and the deviation of the strength of the wire rod is increased. The upper limit of the pushing length, thus, is preferably defined to be 0.3 D of the diameter of the loops of the wire rod.

The invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced the rein.

TABLE 9

| | (wt. %) | | | | | | | |
|---|---|---|---|---|---|---|---|---|
| Steel | C | Si | Mn | P | S | Cu + Ni + Cr | Al | N |
| SWRH 62 B | 0.62 | 0.24 | 0.78 | 0.02 | 0.01 | 0.05 | 0.02 | 0.0041 |
| SWRH 82 B | 0.82 | 0.22 | 0.80 | 0.01 | 0.01 | 0.06 | 0.03 | 0.0032 |
| High Si-Low Mn Steel | 0.85 | 0.98 | 0.25 | 0.02 | 0.01 | 0.07 | 0.02 | 0.0045 |

TABLE 10(a)

| | | First Cooling Step | | | | | | |
|---|---|---|---|---|---|---|---|---|
| | | Spray Water from Above | | Air Blast from Below | | | | |
| No. | Method | Water Flow $m^3/hr$ | Air-Water Ratio $Nm^3/m^3$ | Speed m/s | Water Flow $m^3/hr$ | Time sec | Speed °C./sec | Temp. °/C. |
| 1 | Prior Art | — | — | 50 | — | 18 | 7 | 714 |
| 2 | Present Invention | 70 | 42 | 30 | Fall from Above | 18 | 19 | 498 |
| 3 | Control | | | | Fall from Above | 11 | 19 | 631 |
| 4 | Control | 90 | 42 | 30 | Fall from Above | 18 | 23 | 426 |
| 5 | Present Invention | 90 | 42 | 30 | Fall from Above | 11 | 23 | 587 |
| 6 | Present Invention | 90 | 42 | — | — | 18 | 15 | 570 |
| 7 | Control | 90 | 42 | 30 | Fall from Above | 11 | 23 | 587 |
| 8 | Control | 150 | 20 | 60 | Fall from Above | 9 | 46 | 426 |
| 9 | Control | 70 | 42 | 30 | Fall from Above | 18 | 19 | 498 |
| 10 | Present Invention | — | — | 30 | Addition 80 | 18 | 17 | 534 |
| 11 | Prior Art | 520° C. LP after Heating up to 950° C. | | | | | | |
| 12 | Present Invention | 20 | 0 | 60 | Fall from Above | 19 | 14 | 567 |
| 13 | Present Invention | 140 | 0 | 60 | Fall from Above | 10 | 39 | 450 |
| 14 | Present Invention | 30 | 170 | 40 | Fall from Above | 20 | 18 | 480 |
| 15 | Present Invention | 170 | 0 | — | — | 13 | 28 | 476 |
| 16 | Present Invention | 140 | 60 | 50 | Addition 30 | 7 | 38 | 574 |

TABLE 10(b)

| | Second Cooling Step | | | | | | | |
|---|---|---|---|---|---|---|---|---|
| | | Spray Water from Above | | Air Blast | | | | |
| No. | Method | Water Flow $m^3/hr$ | Air-Water Ratio $Nm^3/m^3$ | from Below (Speed) m/sec | Cooling Time sec | Cooling Speed °C./sec | Finish °C. | Cooling thereafter |
| 1 | Prior Art | — | — | 50 | 18 | 7 | 588 | Natural Cooling |
| 2 | Present Invention | — | — | 50 | 18 | 3 | 444 | Natural Cooling |
| 3 | Control | — | — | 50 | 11 | 7 | 554 | Natural Cooling |
| 4 | Control | — | — | 30 | 18 | 3 | 372 | Natural Cooling |
| 5 | Present Invention | 10 | 180 | 10 | 11 | 12 | 456 | Natural Cooling |
| 6 | Present Invention | — | — | 50 | 11 | 7 | 493 | Natural Cooling |
| 7 | Control | — | — | — | 18 | 1.5 | 560 | Slow Cooling |
| 8 | Control | — | — | — | 18 | Heating 2 | 462 | Heating |
| 9 | Control | — | — | 30 | 18 | 3 | 444 | Rapid Cooling |
| 10 | Present Invention | — | — | 30 | 18 | 3 | 490 | Natural Cooling |
| 11 | 520° C. LP after Heating up to 950° C. | | | | | | | |
| 12 | Present Invention | — | — | 40 | 23 | 5 | 452 | Natural Cooling |
| 13 | Present Invention | — | — | 10 | 11 | 2.2 | 426 | Natural Cooling |
| 14 | Present Invention | — | — | 30 | 18 | 4 | 408 | Natural Cooling |
| 15 | Present Invention | — | — | 20 | 11 | 2.7 | 446 | Natural Cooling |
| 16 | Present Invention | 70 | 90 | 40 | 7 | 14 | 476 | Natural Cooling |

TABLE 11

| | | Species | Tensile Strength | | Drawability | |
|---|---|---|---|---|---|---|
| No. | Method | of Steel Diameter | Average $kgf/mm^2$ | Deviation $kgf/mm^2$ | Average % | Structure |
| 1 | Prior Art | | 93 | 5 | 48 | Coarse F + P |
| 2 | Present Invention | | 107 | 5 | 58 | Minute F + P |
| 3 | Control | | 96 | 5 | 50 | Coarse F + P |
| 4 | Control | SWRH 62 B | 117 | 10 | 45 | Minute F + P + B |
| 5 | Present Invention | | 103 | 5 | 55 | Minute F + P |
| 6 | Present Invention | | 100 | 7 | 54 | Minute F + P |
| 7 | Control | 13 ϕ | 97 | 7 | 50 | Coarse F + P |
| 8 | Control | | 107 | 5 | 57 | Minute F + P |
| 9 | Control | | 110 | 6 | 55 | Minute F + P + M |
| 10 | Present Invention | | 105 | 4 | 56 | Minute F + P |
| 11 | Prior Art | | 104 | 4 | 52 | Minute F + P |
| 12 | Present Invention | | 103 | 6 | 53 | Minute F + P |
| 13 | Present Invention | | 110 | 7 | 56 | Minute F + P |
| 14 | Present Invention | | 106 | 5 | 54 | Minute F + P |
| 15 | Present Invention | | 106 | 6 | 55 | Minute F + P |
| 16 | Present Invention | | 102 | 5 | 52 | Minute F + P |

TABLE 12

| | | Species | Tensile Strength | | Drawability | |
|---|---|---|---|---|---|---|
| No. | Method | of Steel Diameter | Average $kgf/mm^2$ | Deviation $kgf/mm^2$ | Average % | Structure |
| 1 | Prior Art | | 109 | 6 | 35 | Coarse P |
| 2 | Present Invention | | 130 | 5 | 48 | Minute P |
| 3 | Control | SWRH | 112 | 5 | 36 | Coarse P |

TABLE 12-continued

| No | Method | Species of Steel Diameter | Tensile Strength Average kgf/mm² | Tensile Strength Deviation kgf/mm² | Drawability Average % | Structure |
|---|---|---|---|---|---|---|
| | | 82 B | | | | |
| 4 | Control | | 139 | 12 | 30 | Minute P + B |
| 5 | Present Invention | | 125 | 5 | 46 | Minute P |
| 6 | Present Invention | 13ϕ | 121 | 7 | 47 | Minute P |
| 7 | Control | | 114 | 8 | 40 | Coarse P |
| 8 | Control | | 129 | 5 | 49 | Minute P |
| 9 | Control | | 133 | 6 | 46 | Minute P + M |
| 10 | Present Invention | | 127 | 5 | 47 | Minute P |
| 11 | Prior Art | | 125 | 5 | 42 | Minute P |

TABLE 13

| No. | Method | Species of Steel Diameter | Tensile Strength Average kgf/mm² | Tensile Strength Deviation kgf/mm² | Drawability Average % | Structure |
|---|---|---|---|---|---|---|
| 1 | Prior Art | A | 115 | 12 | 28 | Coarse P |
| 2 | Present Invention | 13 ϕ | 141 | 5 | 42 | Minute P |
| 11 | Prior Art | | 140 | 5 | 35 | Minute P |

TABLE 14

| No. | Method | Species of Steel Diameter | Tensile Strength Average kgf/mm² | Tensile Strength Deviation kgf/mm² | Drawability Average % | Structure |
|---|---|---|---|---|---|---|
| 2 | Present Invention | 62 B | 108 | 3 | 60 | Minute F + P |
| 5 | Present Invention | 13ϕ | 104 | 3 | 56 | Minute F + P |
| 6 | Present Invention | | 101 | 3 | 55 | Minute F + P |
| 7 | Prior Art | | 105 | 2 | 53 | Minute F + P |

TABLE 15

| No. | Method | Species of Steel Diameter | Tensile Strength Average kgf/mm² | Tensile Strength Deviation kgf/mm² | Drawability Average % | Structure |
|---|---|---|---|---|---|---|
| 2 | Present Invention | 82 B | 130 | 3 | 49 | Minute P |
| 5 | Present Invention | 13 ϕ | 125 | 3 | 47 | Minute P |
| 6 | Present Invention | | 121 | 3 | 48 | Minute P |
| 11 | Prior Art | | 125 | 2 | 43 | Minute P |

What is claimed is:

1. A method for direct patenting of a hot-rolled wire rod comprising the steps of:

transporting a hot-rolled wire rod on a conveyer, said wire rod being in a form of continuous series of loops, said wire rod containing C in an amount of 0.40 to 1.00 wt.%;

blasting mist to the surface of said wire rod at least from above and blasting air to the back side of said wire rod from below to cool said wire rod at a rate of 12° to 50° C./sec. down to 550° to 400° C. while transporting said wire rod on said conveyer, said mist providing 200 to 2400 l/min. water and has an air-to-water ratio of 200 $Nm^3/m^3$ or less; and reheating said cooled wire rod at a rate of 3° C./sec. or less while transporting said cooled wire rod.

2. The method of claim 1, wherein said blasting mist is blasted to said wire rod only from above.

3. The method of claim 1, wherein said blasting mist is blasted to said wire rod from above and from below.

4. The method of claim 1, wherein said mist is an air-water mist which provides 500 to 2400 l/min. water and has an air-to-water ratio of 20 to 180 $Nm^3/m^3$.

5. The method of claim 1, wherein said mist is spray water which provides 500 to 2400 l/min. water and has an air-to-water ratio which is zero.

6. The method of claim 1, wherein said transporting a hot-rolled wire rod in a state that said wire rod is in a form of continuous series of loops includes transporting said wire rod in a zigzag configuration.

7. The method of claim 6, wherein said transporting said wire rod in a zigzag configuration includes having the loops of said wire rod placed flatly on the conveyer, having the loops turn to the right and the left by turn at every interval of 0.3 to 2.0 of length D in the advancing direction and diagonally relative to the center line of the conveyer, and still having each center of the loops have a deviation relative to the center line of the conveyer, the deviation being within a maximum range of 0.02 to 0.3 of length D, thereby to transport said wire rod, where D is a diameter length of the loops formed by said wire rod.

8. A method for direct patenting of a hot-rolled wire rod comprising the steps of:

transporting a hot-rolled wire rod on a conveyer, said wire rod being in a form of continuous series of loops, said wire rod containing C in an amount of 0.40 to 1.00 wt.%;

blasting mist to the surface of said wire rod at least from above and blasting air to the back side of said wire rod from below to cool said wire rod at a rate of 12° to 50° C./sec. down to 550° C. to 400° C. while transporting said wire rod on said conveyer, said mist providing 200 to 2400 l/min. water and has an air-to-water ratio of 200 $Nm^3/m^3$ or less; and cooling said cooled wire rod slowly at a rate of 2° C./sec. or less while transporting said cooled wire rod.

9. The method of claim 8, wherein said blasting mist is blasted to said wire rod only from above.

10. The method of claim 8, wherein said blasting mist is blasted to said wire rod from above and from below.

11. The method of claim 8, wherein said mist provides 500 to 2400 l/min. water and has an air-to-water ratio of 20 to 180 $Nm^3/m^3$.

12. The method of claim 8, wherein said mist is a spray water mist which provides 500 to 2400 l/min. water and has an air-to-water ratio which is zero.

13. The method of claim 8, wherein said transporting a hot-rolled and coiled wire rod in a state that said wire rod is in a form of continuous series of loops includes transporting said wire rod in a zigzag configuration.

14. The method of claim 8, wherein said transporting said wire rod in a zigzag configuration includes having the loops of said wire rod placed flatly on the conveyer, having the loops turn to the right and the left at every interval of 0.3 to 2.0 of length D in the advancing direction and diagonally relative to the center line of the conveyer, and still having each center of the loops have a deviation relative to the center line of the conveyer, the deviation being within a maximum range of 0.02 to 0.3 of length D, thereby to transport said wire rod, where D is a diameter of the loops formed by said wire rod.

15. A method for direct patenting of a hot-rolled wire rod comprising the steps of:

transporting a hot-rolled wire rod on a conveyer, said wire rod being in a form of continuous series of loops, said wire rod containing C in an amount of 0.40 to 1.00 wt.%;

cooling, as a first cooling step, said wire rod at a rate of 12° to 40° C./sec. down to 600° C. to 450° C. while transporting said wire rod on said conveyer, by means of blasting a cooling medium to said wire rod for 5 secs. to 30 secs.; and cooling, as a second cooling step, said cooled wire rod at a rate of 2° to 15° C./sec. down to 550° to 400° C. while transporting said cooled wire rod by means of blasting a cooling medium to said wire rod cooled in the first cooling step for 5 secs. to 30 secs.

16. The method of claim 15, wherein the first cooling step is cooling said wire rod down to 550° C. to 450° C. by means of blasting said cooling medium to said wire rod.

17. The method of claim 15, wherein said cooling medium is air blast and spray water.

18. The method of claim 17, wherein said spray water is hot water which is sprayed.

19. The method of claim 15, wherein said cooling medium in the first cooling step is air blast and air-water mist.

20. The method of claim 19, wherein said air-water mist comprises air-mist formed from air and hot water.

21. The method of claim 19, where said cooling medium in the first cooling step is air mist which comprises air blast mixed with spray water.

22. The method of claim 15, wherein said cooling medium in the first cooling step is air blast mist which comprises air blast mixed with air-water mist.

23. The method of claim 15, wherein said second cooling step is blasting a cooling medium to said wire rod to cool down to 500° C. to 400° C.

24. The method of claim 15, wherein said cooling medium in the second cooling step is air-blast which is blasted to said wire rod from therebelow.

25. The method of claim 15, wherein said cooling medium in the second cooling step is air-blast mist which comprises air blast mixed with spray water.

26. The method of claim 15, wherein said cooling medium in the second cooling step is air-blast mist which comprises air blast mixed with air-water mist.

27. The method of claim 15, wherein said cooling in the second cooling step is cooling said wire rod at a rate of 2° to 8° C./sec.

28. The method of claim 15, wherein said cooling in the second cooling step is cooling said wire rod at a rate of over 8° to 15° C./sec.

29. The method of claim 15, wherein said transporting a hot-rolled wire rod in a state that said wire rod is in a form of continuous series of loops includes transporting said wire rod in a zigzag configuration.

30. The method of claim 29, wherein said transporting said wire rod in a zigzag configuration includes having the loops of said wire rod placed flatly on the conveyer, having the loops turn to the right and the left at every interval of 0.3 to 2.0 of length D in the advancing direction and diagonally relative to the center line of the conveyer, and still having each center of the loops have a deviation relative to the center line of the conveyer, the deviation being within a maximum range of 0.02 to 0.3 of length D, thereby to transport said wire rod, where D is a diameter of the loops formed by said wire rod.

* * * * *

UNITED STATES PATENT AND TRADEMARK OFFICE
CERTIFICATE OF CORRECTION

PATENT NO. : 5,125,987

DATED : June 30, 1992

INVENTOR(S) : Toyoaki Eguchi et al

It is certified that error appears in the above-identified patent and that said Letters Patent is hereby corrected as shown below:

Title page, left column, above "Primary Examiner", insert --[56] References Cited

U.S. PATENT DOCUMENTS

| | | |
|---|---|---|
| 4,320,646 | 3/1982 | Bindernagel et al.....148/12B |

FOREIGN PATENT DOCUMENTS

| | | |
|---|---|---|
| 45-23215 | 8/1970 | Japan.....148/15B |
| 53-52229 | 5/1978 | Japan.....148/12B |
| 61-117226 | 6/1986 | Japan.....148/12B |
| 2137707 | 2/1973 | W. Germany....148/12B--. |

Column 5, line 4, after "procure", insert --a--.

Column 5, lines 11-12, delete "a wire".

Column 5, line 12, delete "uniform. Water particles even" and insert --uniform water particles. Even--.

Signed and Sealed this

Twenty-ninth Day of November, 1994

*Attest:*

Bruce Lehman

BRUCE LEHMAN

*Attesting Officer*

*Commissioner of Patents and Trademarks*